US005581180A

United States Patent [19]

Ito et al.

[11] Patent Number: 5,581,180

[45] Date of Patent: Dec. 3, 1996

[54] HORIZONTAL AND VERTICAL DISPLACEMENT DETECTOR OF WIRE ROPE

[75] Inventors: Norio Ito; Tatsuya Shimoda; Sumitaka Wako; Toshiyuki Ishibashi; Yasunori Ueki; Makoto Okeya, all of Suwa; Mitsuho Matsuzawa, Matsumoto, all of Japan

[73] Assignees: Seiko Epson Corporation, Tokyo; Cosmo System Corporation, Nagano, both of Japan

[21] Appl. No.: 244,270

[22] PCT Filed: Nov. 27, 1992

[86] PCT No.: PCT/JP92/01560

§ 371 Date: Nov. 3, 1994

§ 102(e) Date: Nov. 3, 1994

[87] PCT Pub. No.: WO93/11015

PCT Pub. Date: Jun. 10, 1993

[30] Foreign Application Priority Data

Nov. 29, 1991 [JP] Japan ..... 3-316194
Dec. 2, 1991 [JP] Japan ..... 3-317246

[51] Int. Cl.[6] ..... G01R 33/00; G01R 33/06

[52] U.S. Cl. ..... 324/207.11; 324/207.15; 324/207.2; 324/207.24

[58] Field of Search ..... 324/207.11, 207.13–207.16, 324/207.2, 207.21, 207.24, 207.25, 228, 262, 175, 234, 236; 338/32 H

[56] References Cited

U.S. PATENT DOCUMENTS

| | | | |
|---|---|---|---|
| 2,452,156 | 10/1948 | Schover | 324/207.11 |
| 3,226,631 | 12/1965 | Kuhrt et al. | 324/207.2 |
| 4,818,939 | 4/1989 | Takahashi et al. | 324/207.21 |
| 5,025,213 | 6/1991 | Dobler et al. | 324/207.24 |
| 5,315,244 | 5/1994 | Griebeler | 324/207.21 |

*Primary Examiner*—Louis M. Arana
*Assistant Examiner*—J. M. Patidar
*Attorney, Agent, or Firm*—Kanesaka & Takeuchi

[57] ABSTRACT

A displacement detector detects a relative position between a wire rope and a pulley of a transfer apparatus. The detector includes a magnet disposed to face the wire rope, two magnetoelectric conversion units disposed relative to a pitch of lays of the wire rope to produce two output voltages having ripple components caused by the pitch of lays and being opposite to each other in terms of phase, and a circuit unit connected to the magnetoelectric conversion units for detecting displacement degrees of the wire rope from the pulley according to the output voltages and adding the output voltages so that said ripple components of opposite phases offset each other thereby removing effects of said pitch of lays.

16 Claims, 35 Drawing Sheets

HORIZONTAL AND VERTICAL DISPLACEMENT DETECTOR OF WIRE ROPE

TECHNICAL FIELD

This invention relates to a displacement detector of a rope against a guide member for detecting a displacement degree when the rope guided by a guide member such as a pulley is displaced from a standard point set in the guide member, and to a drive control device of a transfer member for controlling a driving speed by means of the displacement detector.

BACKGROUND ART

Heretofore, a transfer apparatus having a rope guided by a guide member includes, for example, a lift device, car gondola device, ropeway, and cable car (hereinafter referred to as the lift device) which consist of pulleys and wire ropes, and what is generally known is a ski lift which is disposed at skiing grounds. In such a ski lift, because of its structure, carriers suspended from the wire rope have a drawback of being easily influence by a side wind with resect to the moving direction of the carriers. In addition, since the ski lift is disposed among the mountains where a gust of wind blows, there is a danger that the wire rope easily comes off the pulley because of the sway of the carriers from side to side due to a side wind. For a safety precaution, an off-position detector is disposed on each left device to detect the off-position of the wire rope from a pulley on one hand, and a monitor camera is used to monitor the sideward sway of the carriers on the other hand.

The above off-position detector detects the off-position of the wire rope from a pulley when the wire rope displaced from the pulley presses a switch such as a limit switch which is disposed on the side of the pulley. And, to monitor the sideward sway of carriers with the monitor camera, monitor cameras are disposed at a plurality of places along the stretched direction of the wire rope, and a man keeps observing the sideward sway of carriers due to wind on monitors from the cameras.

In the lift device, the pulley is generally fixed and the wire rope is designed to travel, but there is a lift device where the wire rope is conversely fixed and the pulley travels, and there is a danger in the same way as above that the pulley is easily displaced from the wire rope because of a sideward swat of the carrier due to a side wind. Now, description will be made with reference to an example where the wire rope travels.

Incidentally, the aforementioned conventional off-position detector is aimed at preventing a secondary hazard which may be caused by operating the lift with the wire roped displaced from a pulley, and has a problem that it cannot prevent the off-position of the wire rope from the pulley. And, monitoring of the sideward sway of carriers through the monitor cameras can hardly prevent the wire rope from coming off of the pulley groove due to a gust of wind. Further, the recent ski lift is operated at a high speed and the number of lifts carrying a plurality of passengers are increasing, and a gondola and ropeway are enlarging in size, and accordingly the possibility of off-position of the wire rope from the pulley is increasing, leading to the increase of injured people due to accidents every year. In addition, to monitor the sideward sway of carriers through the conventional monitor cameras, it is not efficient because a man has to keep watching, and there is a defect that a standard for judging the presence or not of danger as to the degree of sideward sway of carriers is vague. Furthermore, to dispose the above plurality of monitor cameras to many existing lift facilities, construction work is made on a large scale, and so there is a disadvantage that the cost of construction becomes high.

In view of the above, this invention aims to provide a displacement detector of a metallic rope against a guide member which detects a displacement degree of a wire rope from a guide member, so that the off-position of the rope from the pulley can be prevented automatically efficiently, and which can be easily installed to existing lift facilities; and also aims to provide a drive control device of the transfer member which detects a displacement degree of a rope from a standard position in a pulley groove at a plurality of points, controls and operating speed of the transfer member according to each displacement degree to prevent the off-position of the rope from the pulley groove automatically and efficiently, improves the safety and carrying capacity of the lift substantially, and can be easily disposed on existing lift facilities.

DISCLOSURE OF THE INVENTION

This invention is a detector for detecting a relative position between a rope (2) and a guide member (13) in a transfer apparatus including the rope (2) travelling by itself or fixed to a support; the guide member (13) such as a pulley engaging with the rope, and fixed to the support or travelling by itself; a transformer member travelling with the rope (2) or with the guide member (13); and a displacement detector (1) for detecting a relative position between the rope and the guide member, fitted in the proximity of the guide member (13) and keeping a gap with the guide member always constant; wherein the displacement detector (1) includes medium generation means for generating a position detecting medium emitted from the detector towards the rope (2) and detector means for detecting the displacement of this medium. According to this invention, a displacement degree of the rope, particularly a displacement degree from a standard position when displaced from an optional position as a standard can be detected by a simple structure, so that the off-position of the rope such as a wire rope from the guide member such as a pulley can be prevented automatically and efficiently by disposing the detector at a prescribed position.

And, this invention provides a speed control means to drive the transfer member to the displacement detector, and this speed control means is a drive control device of the transfer member for controlling a speed of the transfer member according to an output signal of a displacement degree from the displacement detector. According to the device of this invention, a displacement degree of the rope from the standard point determined within the guide member is detected by the displacement detector, and according to the displacement degree, the operating speed of the transfer member is synthetically controlled according to the displacement degree so as to be able to prevent the rope from being displaced from the guide member automatically and efficiently, improving the safety and carrying capacity of the transfer member substantially.

BEST MODE FOR CARRYING OUT THE INVENTION

The displacement detector of a rope in a first embodiment to a fifteenth embodiment detects a displacement degree of a wire rope with respect to a guide member according to an output voltage from a magnetoelectric conversion means which is disposed in a magnetic circuit formed by a magnet and a wire rope wherein the magnet is disposed to face the wire rope which is made of a magnetic substance. In other words, magnetism is used as a medium for detecting a position emitted from the detector toward the rope.

Figure 1:
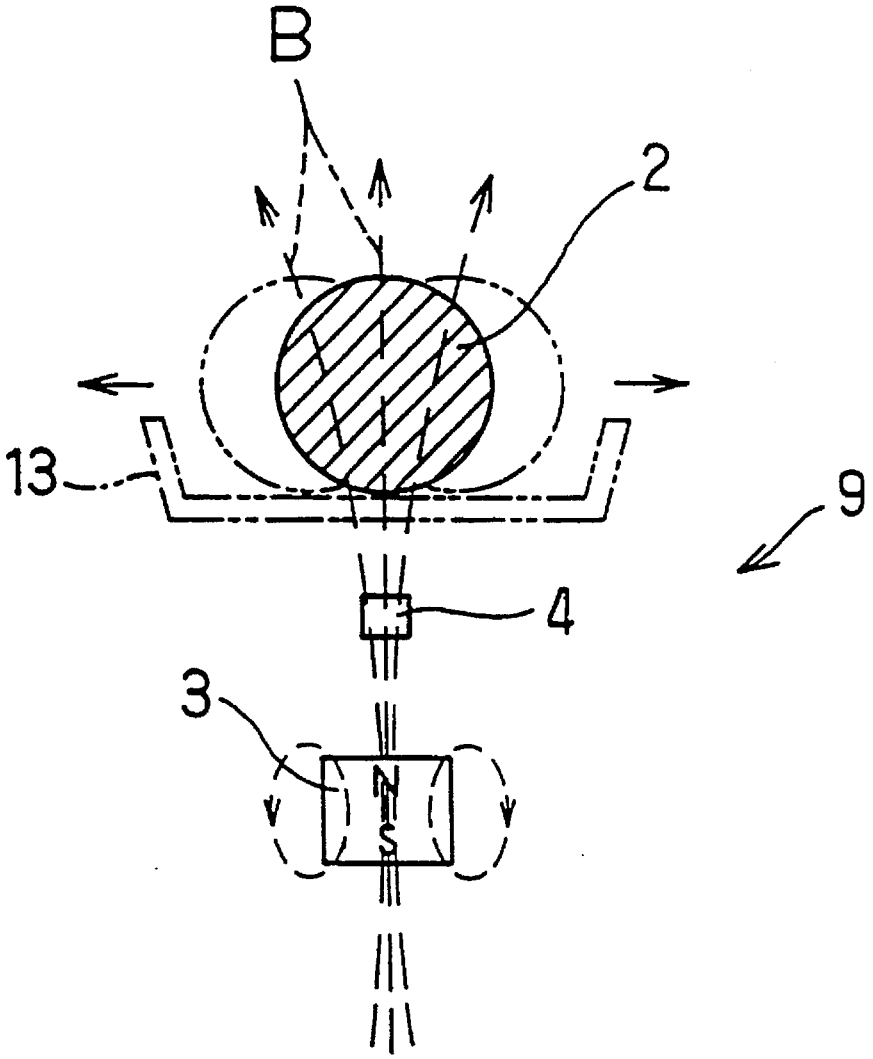
FIG. 1 is a schematic illustration of the displacement detector for the metallic rope in the guide member in a first embodiment of this invention.
Figure 3:
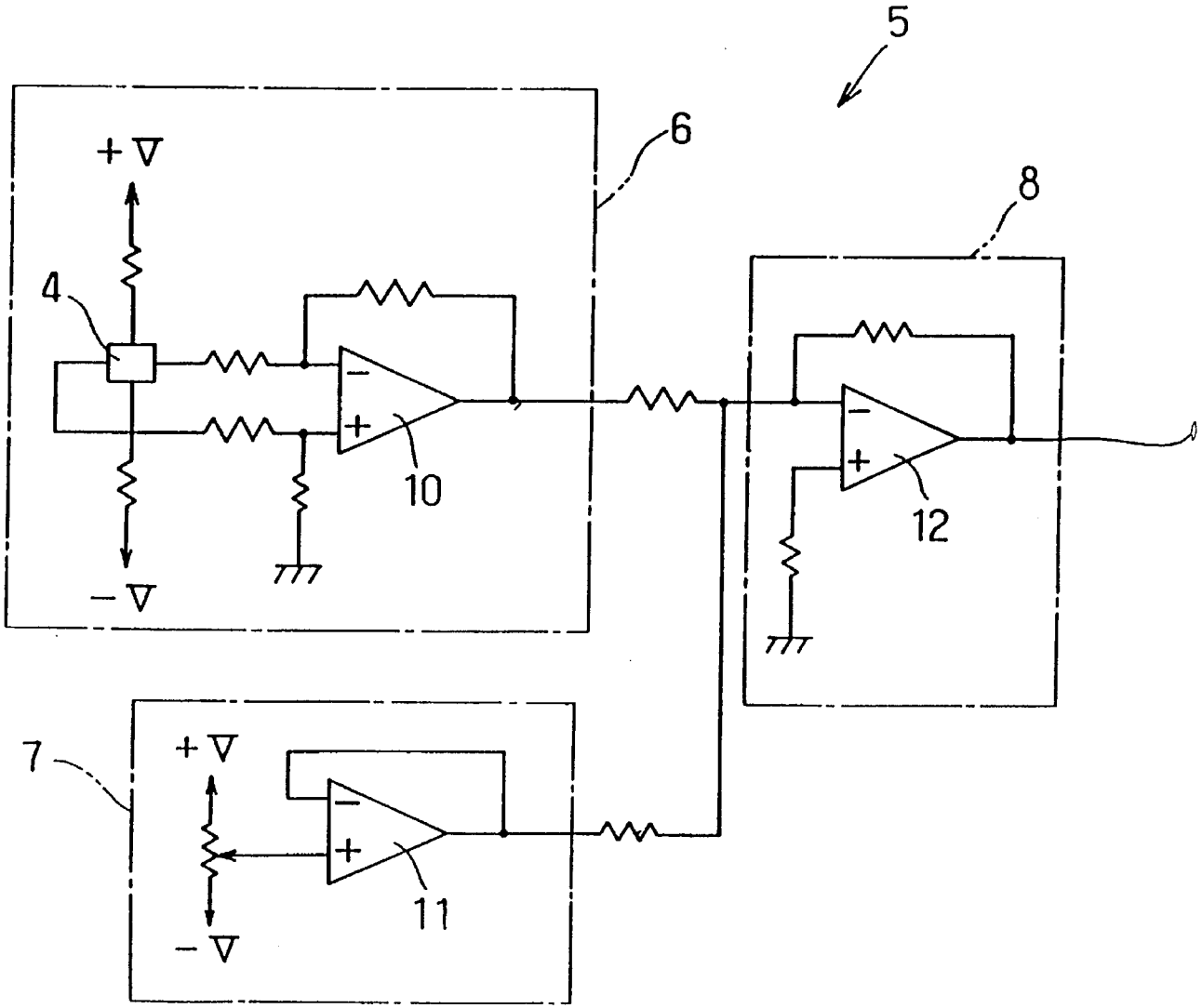
FIG. 3 is a circuit diagram showing the detection circuit using the hall element.

A displacement detector 1 of a first embodiment consists of a pulley 13 which is a guide member for guiding a wire rope 2, a magnet 3 which is kept at a certain distance from the pulley 13 and disposed with its either magnetic pole opposed to the wire rope 2, magnetic flux B which is generated from N pole of the magnet 3 and passes through the wire rope 2, a hall element 4 which is a magnetoelectric conversion element disposed on the magnetic flux B, and a detection circuit 5 shown in FIG. 3 for detecting an output voltage from the hall element 4 as shown in FIG 1.

The above magnet 3 is a permanent magnet, and has a prescribed volume according to detection accuracy or range of a displacement degree, or a prescribed volume and energy product. In FIG. 1, N pole is opposed to the wire rope 2, but S pole may be opposed to the wire rope 2.

A magnetic circuit 9 which forms magnetic flux B which is emitted from N pole of the magnet 3, passes across the wire rope 2 and returns to S pole is formed by the wire rope 2 and the magnet 3. In this invention, a displacement degree of the wire rope 2 is obtained by detecting a change of magnetic flux quantity in the magnetic circuit 9 by the hall element 4 to be described afterward.

Figure 2:
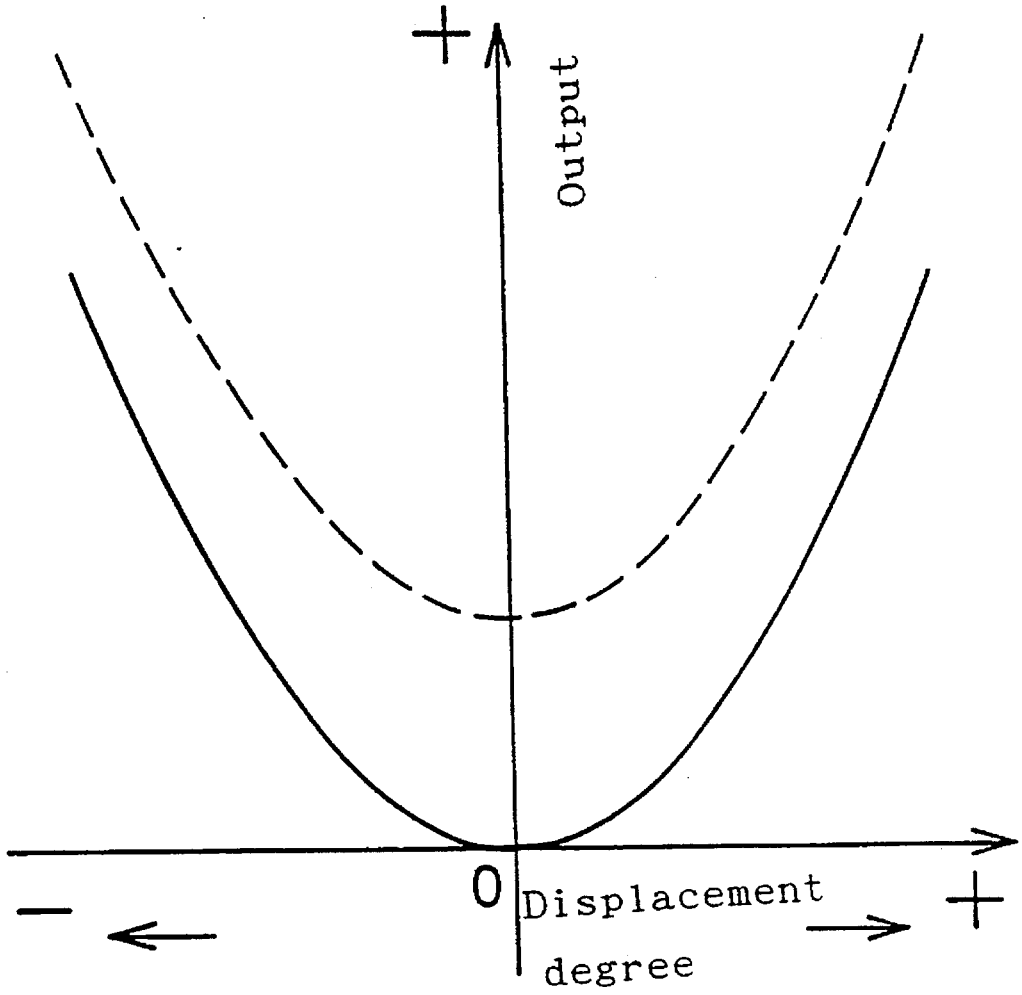
FIG. 2 is a diagram showing the output characteristics of the hall element with respect to a displacement degree.

The above hall element 4 is disposed on the magnetic circuit 9 immediately above the magnetic pole (N pole) on the side of the wire rope 2 from the magnet 3 as shown in FIG. 1 and detects a variation of magnetic flux B in the magnetic circuit 9. This hall element 4 is one which is called as a magnetoelectric conversion element and obtains a prescribed voltage in proportion to a change of magnetic flux quantity applied to the element; FIG. 2 shows output characteristics in this embodiment. The displacement degree in the figure indicates a sideward displacement when the wire rope 2 is moved in a horizontal direction (indicated by the arrows) from a standard of displacement which is determined when the wire rope 2 is positioned immediately above the magnetic pole, and an output (voltage) from the hall element 4 in proportion to the sideward displacement is obtained as an absolute value. The broken line in FIG. 2 indicates an output due to a static magnetic field already applied to the hall element 4, and is adjusted to an output characteristic indicated by the solid line by an offset cancel part 7 of the detection circuit 5 to be described afterward. In FIG. 2, when the plus direction of the displacement degree is for example in the right direction with respect to the standard position, the minus direction is in the left direction with respect to the standard position.

Therefore, magnetic flux B passing through the wire rope 2 which is a magnetic substance is formed by the magnetic circuit 9, and with the magnetic flux quantity to be applied to the hall element 4 when the wire rope 2 is on the standard position as the standard of a displacement degree, the increased or decreased quantity is obtained from the magnetic flux quantity which is applied to the hall element 4 by magnetic flux B which is deflected by being attracted toward the wire rope 2, to detect a displacement degree of the wire rope 2 from the standard position.

The above detection circuit 5 is to amplify the output voltage from the hall element 4 and to remove the output by the static magnetic field. This detection circuit 5 comprises a differential amplifying part 6, an offset cancel part 7, and an inversion amplifying part 8 as shown in FIG. 3.

The above differential amplifying part 6 is a common differential amplifying circuit comprising an operation amplifier 10 whose plus and minus terminal on the input side are connected with two output lines from the above hall element 4, and amplifies a deviation of the output voltage which is outputted from the hall element 4 toward between both output lines. Thus, noise is remedied by receiving the input by differential amplification. The voltage applied to the hall element 4 is to flow a prescribed input electricity to drive the hall element 4. In this embodiment, the output voltages with the polarity of the differential amplifying part 6 inverted from the output side is outputted.

The above offset cancel part 7 is to remove the output by the above static magnetic field and comprises an operation amplifier 11 wherein an offset adjusting resistor is connected to the minus terminal on the input side, and the plus terminal is directly connected to the output side. And, DC voltage (offset cancel voltage) of straight polarity equivalent to the output by the static magnetic field is outputted from the output side of the operation amplifier 11. Thus, the output voltage having the output by the static magnetic field deducted from the output voltage of reversed polarity outputted from the differential amplifying part 6 is obtained.

The above inversion amplifying part 8 further amplifies the output voltage which is determined to be a net segment based on the variation of magnetic flux B by the above offset cancel voltage, and also invert the polarity to the positive electrode. Thus, it is an inversion amplifying made by a common operation amplifier 12. The resistor in FIG. 3 is for setting a amplification factor.

Figure 4:
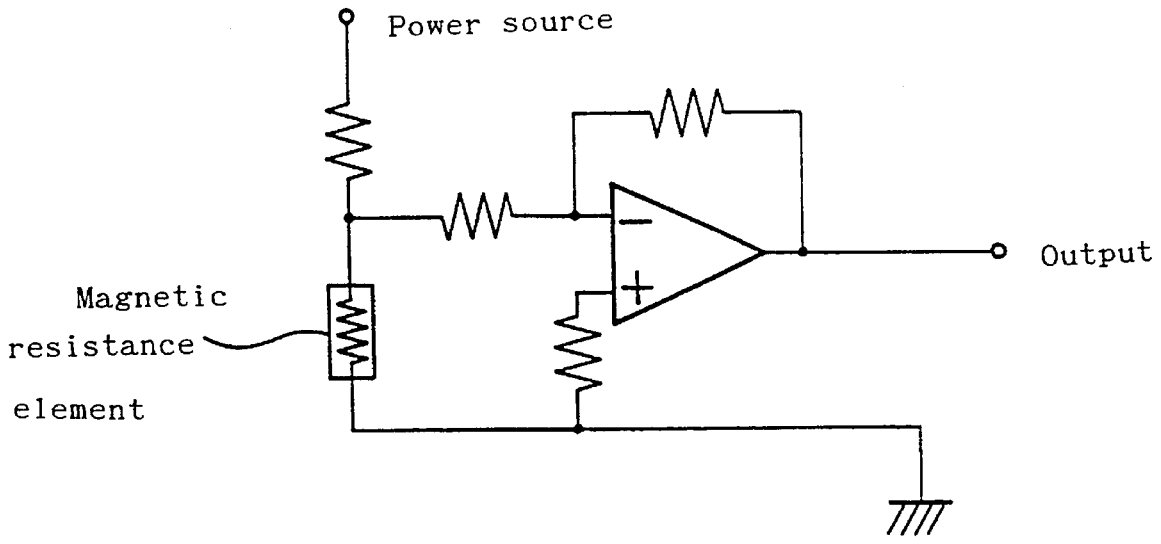
FIG. 4 is a circuit diagram using a magnetic resistance element.
Figure 5:
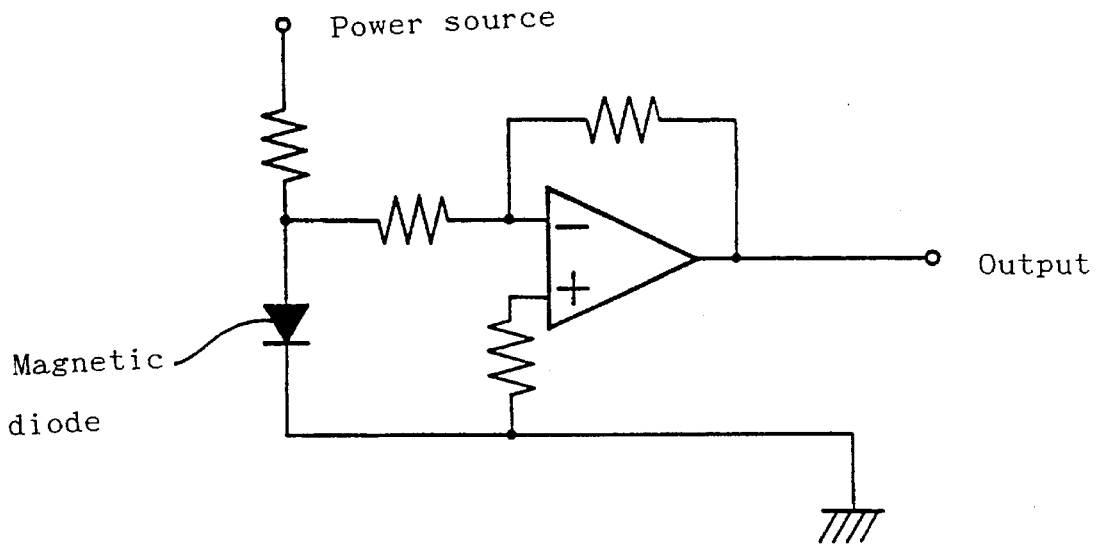
FIG. 5 is a circuit diagram using a magnetic diode.

In the above embodiment, the hall element was used, but the magnetic resistor element shown in FIG. 4 or a magnetic diode shown in FIG. 5 may be used. And, in FIG. 4 and FIG. 5, description of the offset cancel circuit has been omitted.

Figure 16:
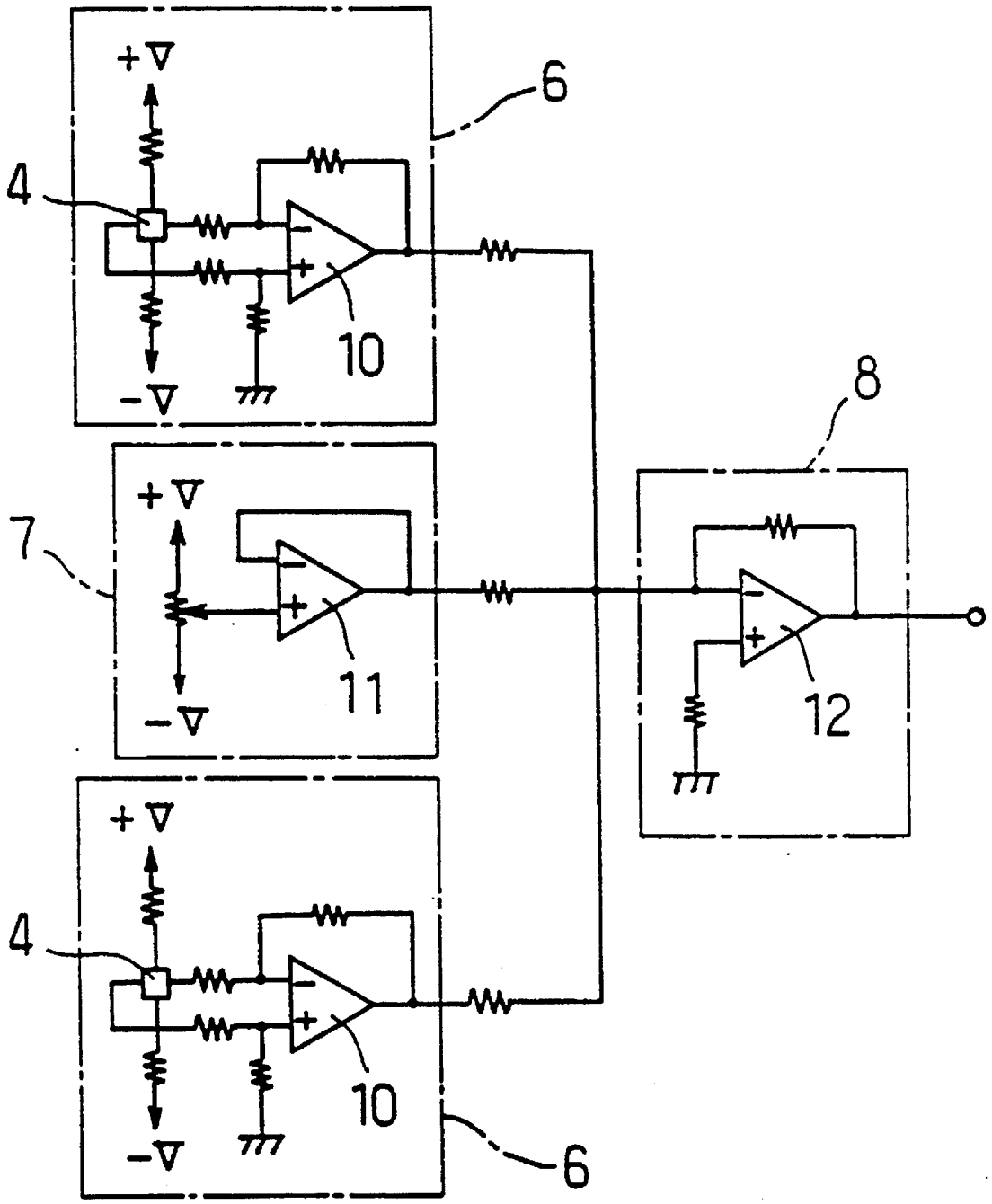
FIG. 16 is a circuit diagram showing the detection circuit for detecting a displacement degree by removing a ripple component.

In FIG. 16, the above displacement detector 1 which is used for a ski lift device 15 will be described. In the following description, the transfer member of this invention may be described as a lift, and the transfer apparatus may be described as a lift device.

The ski lift device 15 is constituted by building a plurality of posts on a slope at a skiing ground, rotatably supporting a plurality of pulleys 13 at the upper part of the posts, stretching the wire rope 2 from which carriers are suspended through the peripheral groove of each pulleys, and driving the wire rope in the stretched direction to move the carriers.

Figure 6:
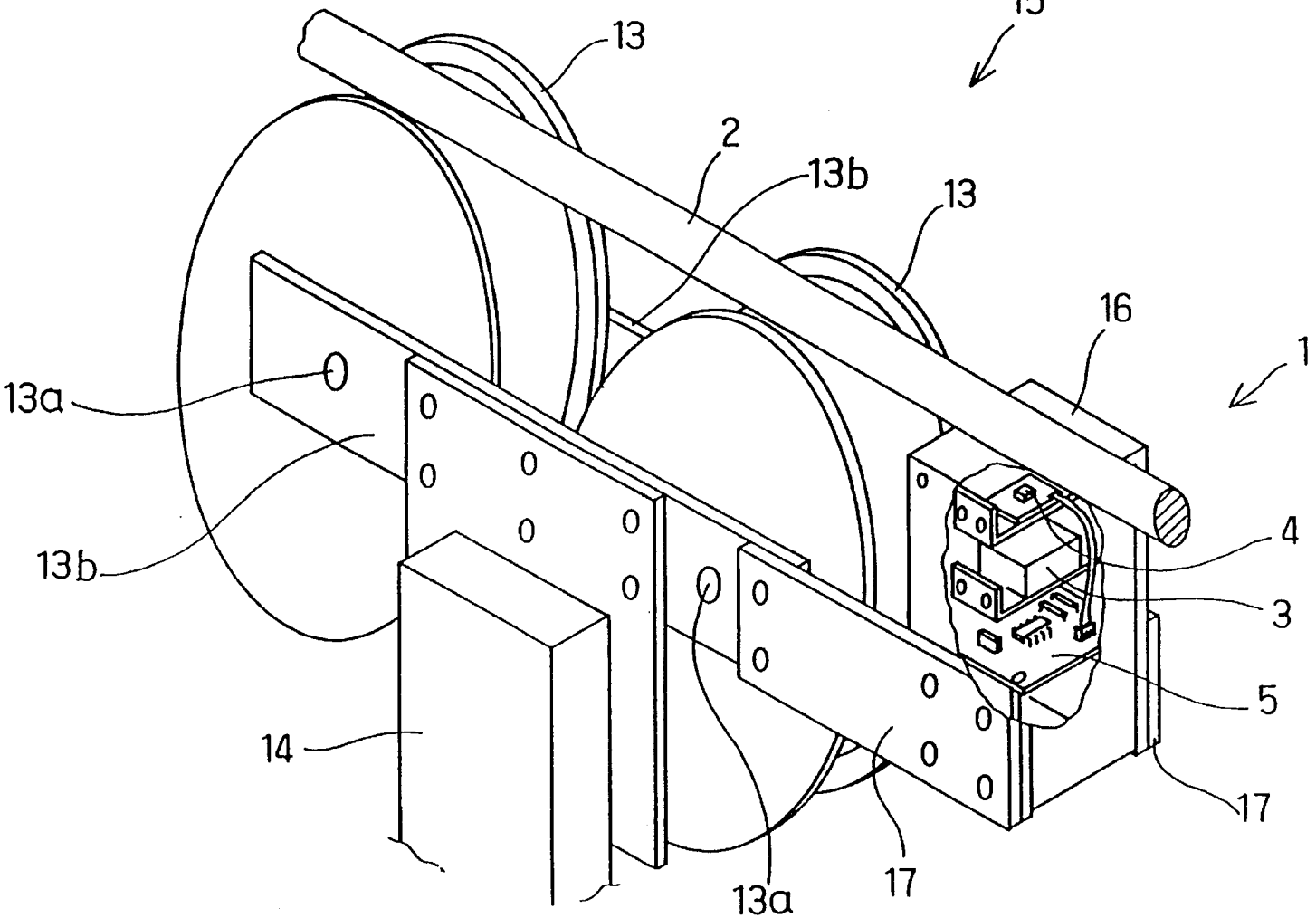
FIG. 6 is a perspective view showing the displacement detector attached to the pole of a ski lift.

The above displacement detector 1 is configured by accommodating the hall element 4, magnet 3, and detection circuit 5 from the top in a detection unit 16 as shown in FIG. 6, and this detection unit 16 is attached to the upper part of the pole 14 by means of fixing plates 17 along the peripheral groove direction of the pulley 13. The detection unit 16 is attached below the wire rope 2, on the side of the wire rope 2 opposite from the side where the lift is travelling, or above the wire rope 2. In other words, since a member in the vertical direction of the lift is designed to pass one side (opposite from the post) of the pulley, the detection unit 16 is disposed at a position excepting a portion where the lift member passes.

Since a plurality of pulleys 13 are on the post 14, the detection unit 16 is attached between the pulleys or positioned outside of the pulleys. In the embodiment of FIG. 6, a plate 17 is disposed to and projected form each bearing plate **13*b* which supports bearings 13*a* of the pulleys 13, and the detection unit 16 is attached between the plates 17. In this embodiment, the detection unit 16 is disposed outside of the pulley 13**.

When the detection unit 16 is attached, the standard position of displacement of the displacement detector 1 shall be aligned with the bottom center position of the pulley peripheral groove. Thus, a displacement degree to be generated when the wire rope 2 stretched to the pulley groove is displaced from the standard position in the groove can be always detected, and the off-position of the wire rope from the pulley groove can be prevented automatically and efficiently. Since the hall element 4 is used, an abrupt displacement of the wire rope 2 by a gust of wind or a change gradually caused over a long time can be detected at high sensitivity. The standard position of displacement is optional.

Figure 7:
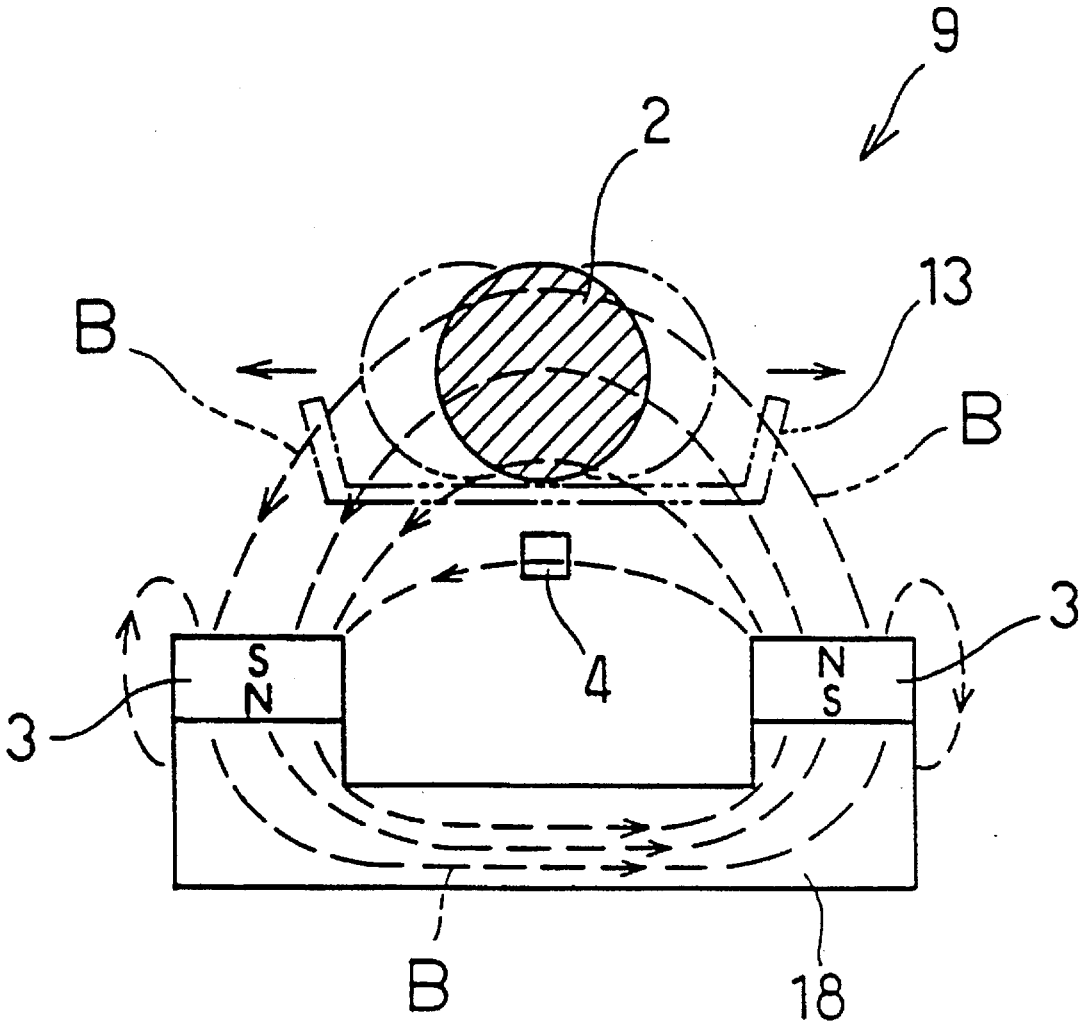
FIG. 7 is a schematic illustration of the displacement detector for the metallic rope in the guide member in a second embodiment.
Figure 8:
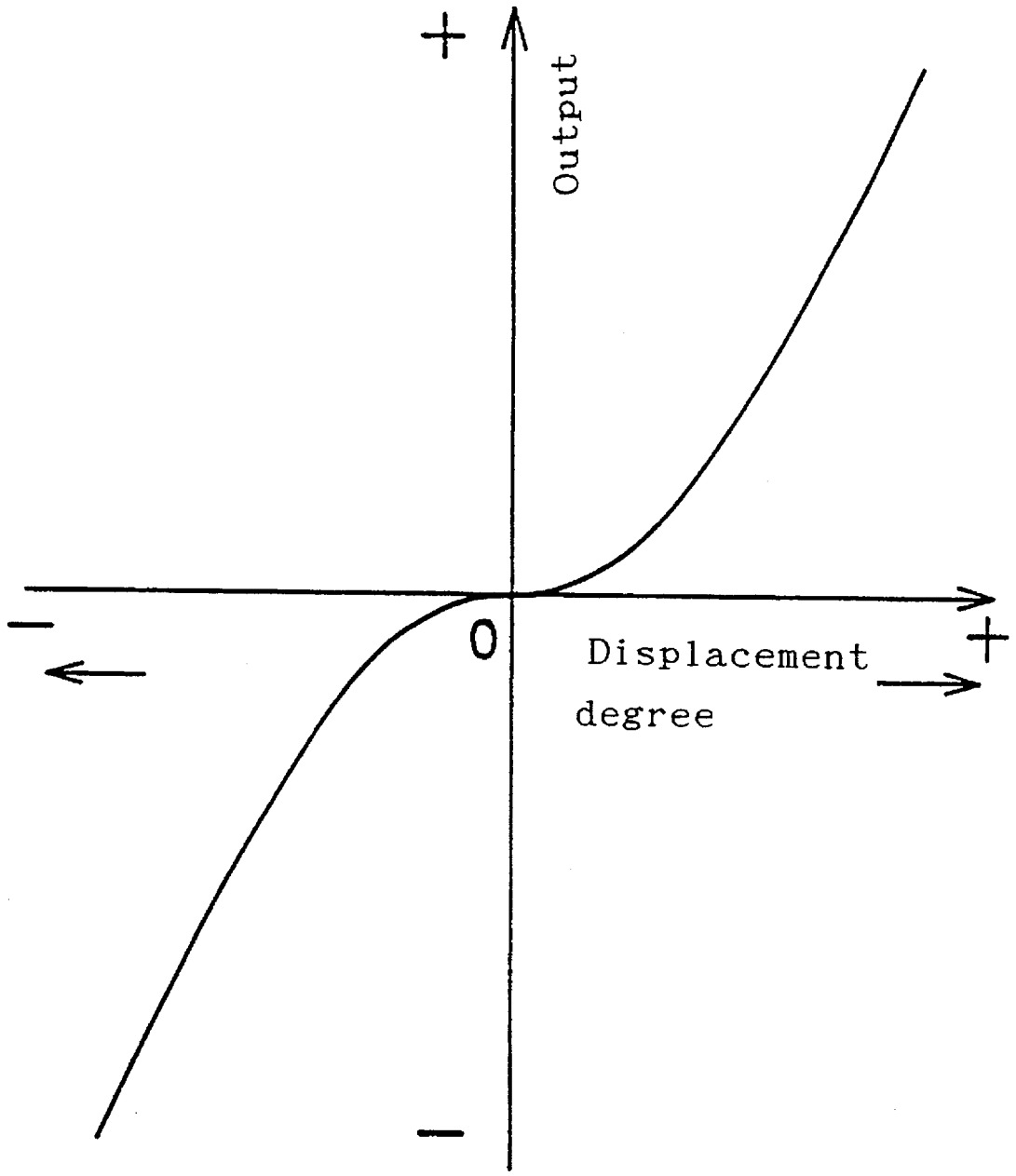
FIG. 8 is a diagram showing the output characteristics of the hall element with respect to a displacement degree.

Other embodiments will be described one after another with reference to the drawings. In the displacement detector 1 according to a second embodiment shown in FIG. 7, two magnets 3, 3 are disposed on both ends of yoke 18 with a certain interval therebetween with different magnetic poles faced against the wire rope 2 to comprise the magnetic circuit 9 which forms magnetic flux B being generated from N pole of one magnet 3, passed across the wire rope 2 or through the yoke 18, and returned to S pole of the other magnet 3. In this case, as compared with the case using a single magnet 3, displacement detecting sensitivity is improved and magnet quantity is decreased. In the first embodiment, the direction of displacement of the wire rope 2 was not clear because the output from the hall element was an absolute value, but in this embodiment, the direction of displacement with respect to the horizontal direction can be specified because the output characteristics shown in FIG. 8 are obtained. The detection circuit is the same as in the first embodiment.

Figure 9:
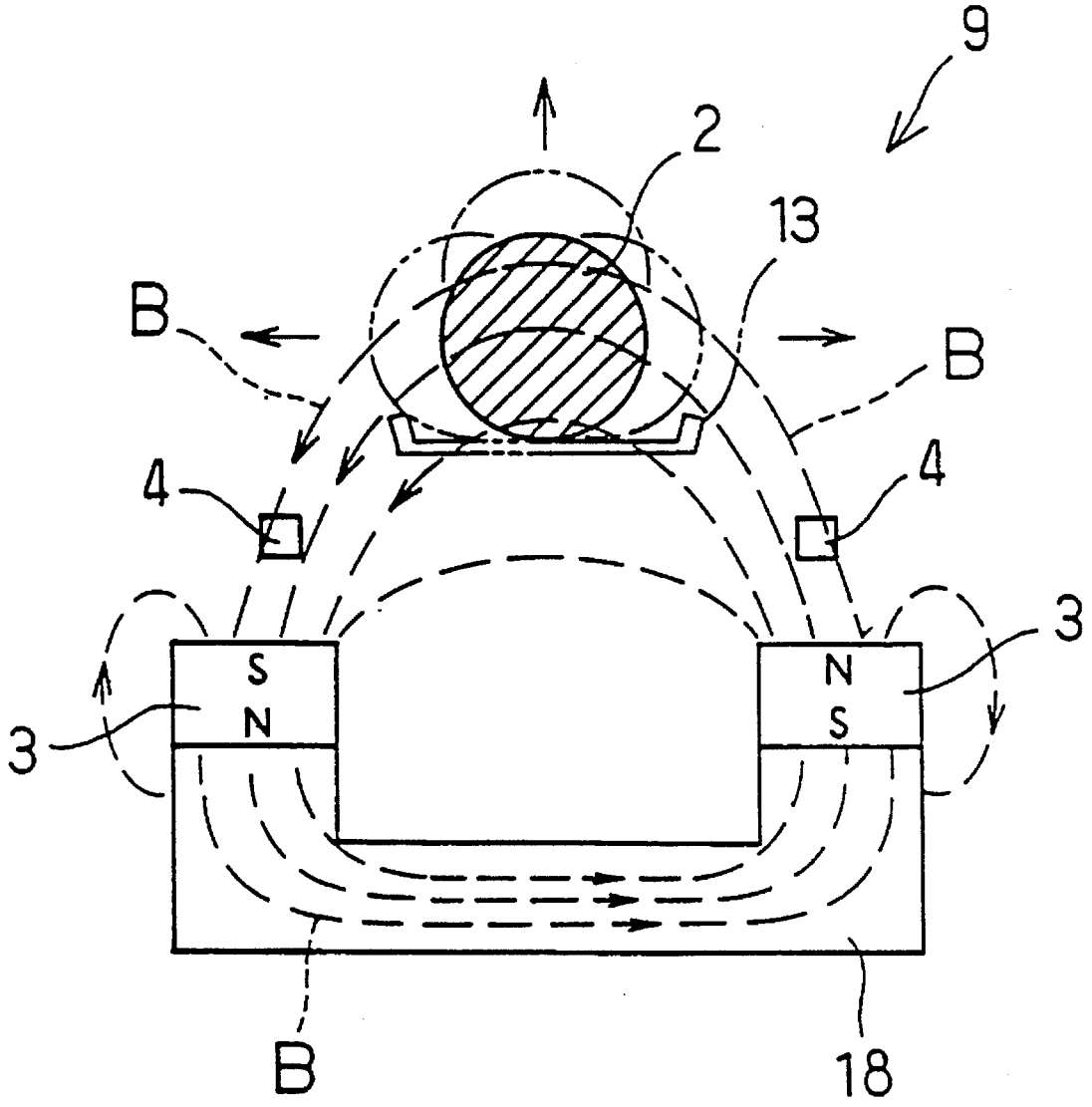
FIG. 9 is a schematic illustration of the displacement detector for the metallic rope in the guide member in a third embodiment.

In the displacement detector 1 according to a third embodiment shown in FIG. 9, two magnets 3, 3 are disposed with a certain interval therebetween to comprise the magnetic circuit 9 which forms magnetic flux B being generated from N pole of one magnet 3, passed across the wire rope 2 or through the yoke 18, and returned to S pole of the other magnet 3, and two hall elements 4, 4 are disposed at certain positions on the magnetic circuit 9. As compared with the second embodiment wherein the displacement direction can be specified in the horizontal direction only, this embodiment can specify the displacement direction in the vertical direction separately from the horizontal direction. To distinguish the vertical and horizontal displacement directions, when the magnetic flux quantity to be detected by the hall element is regarded as the magnitude of magnetic flux quantity by removing the polarity in view of magnetism, a displacement of the wire rope 2 in the horizontal direction increases the magnetic flux quantity which is detected by either hall element and decreases the magnetic flux quantity which is detected by the other hall element. From a difference obtained by deducting the reduced magnetic flux quantity from the increased magnetic flux quantity, it can be specified that the wire rope 2 has been displaced in the horizontal direction. In this case, even if the increased magnetic flux quantity is added to the decreased magnetic flux quantity, the magnetic flux quantity is constant, and the displaced direction cannot be obtained. And, when the wire rope 2 is displaced in the vertical direction, the magnetic flux quantities to be detected by both hall elements 4, 4 are increased or decreased in the same way, and from the sum obtained by adding the magnetic flux quantities detected by both hall elements 4, 4, it can be specified that the wire rope 2 has been displaced in the vertical direction. In this case, even if one magnetic flux quantity is deducted from the other magnetic flux quantity, the magnetic flux quantity is constant, and the displaced direction cannot be obtained.

Figure 10:
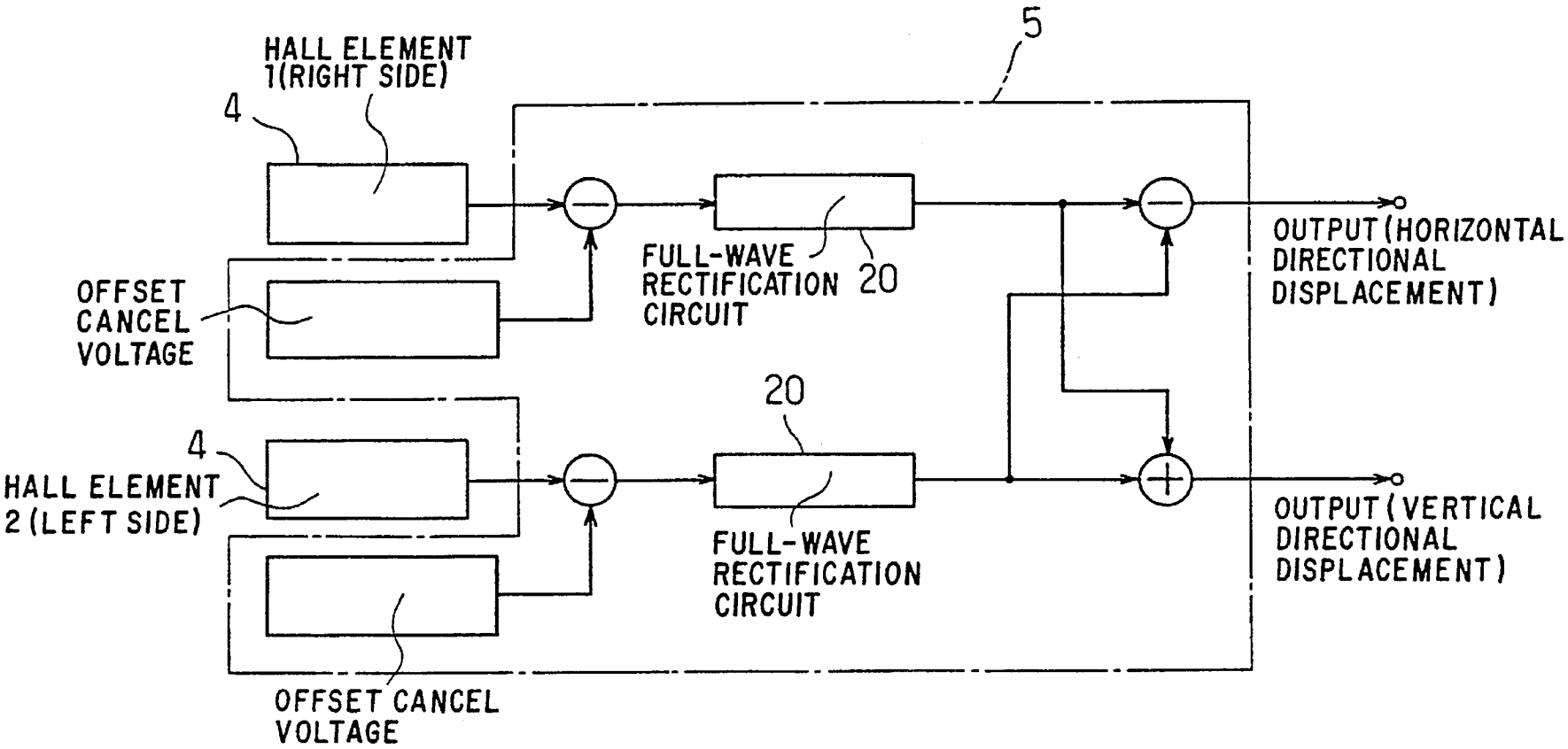
FIG. 10 is a block diagram showing an independent detection of the displacement degree in vertical and horizontal directions.

As a specific means to detect the displacement in the vertical and horizontal directions, as shown in FIG. 10, an offset cancel voltage is deducted from each output voltage which is outputted from the two hall elements 4, 4, each obtained difference is taken into a full-wave rectification circuit 20 to get an absolute value of a mere magnetic flux quantity without polarity in view of magnetism, one absolute value is deducted from the other absolute value to obtain the displacement direction and displacement degree in the horizontal direction, and one absolute value is added to the other absolute value to obtain the displacement direction and displacement degree in the vertical direction. Thus, it is possible to identify if the displacement of the wire rope from the groove is a displacement in the vertical direction due to a bound or a displacement in the horizontal direction due to a wind.

Figure 11:
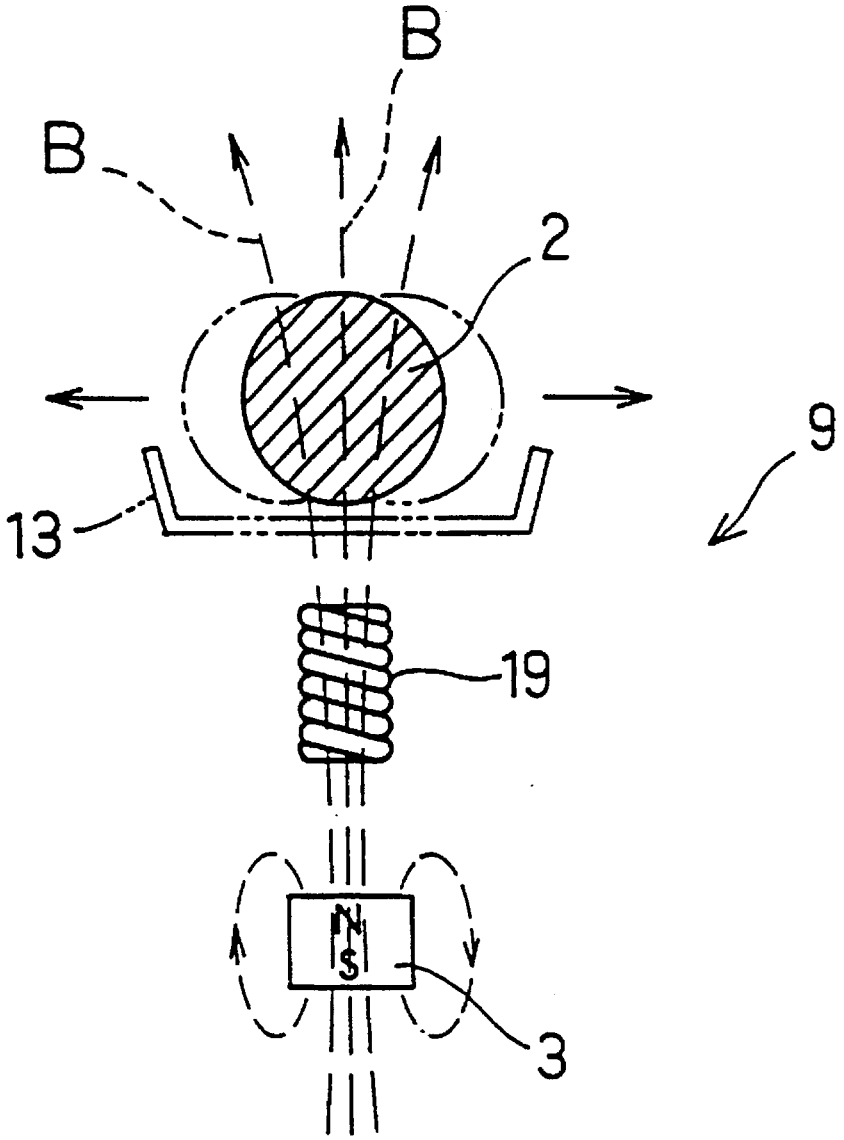
FIG. 11 is a schematic illustration of the displacement detector for the metallic rope in the guide member in a fourth embodiment.

The displacement detector 1 according to a fourth embodiment shown in FIG. 11 obtains the displacement degree of magnetic flux B from an induced electromotive force generated in a coil due to a change of magnetic flux B interlinking with the coil, while the first to third embodiment obtain the displacement degree of magnetic flux B from a magnetic flux quantity detected by the hall element. The displacement detector 1 of this embodiment comprises the magnet 3 disposed with either magnetic pole faced toward the wire rope 2, a coil 19 disposed on magnetic flux B which is generated from N pole of the magnetic 3 and passed across the wire rope 2, and the detection circuit 5 for detecting the output voltage from the coil 19, as shown in FIG. 11.

The above coil 19 is disposed on the magnetic circuit 9 immediately above the magnetic pole (N pole) of the magnet 3 on the side of the wire rope 2, and the above magnetic flux B is interlinked with the coil 19 as shown in FIG. 11. Therefore, it is determined as a standard of displacement when the wire rope 2 is positioned immediately on the above magnetic pole, and magnetic flux B interlinked with the coil 19 in the standard of displacement is determined as a standard of displacement degree, then a variation of magnetic flux B is obtained from an induced electromotive force generated in the coil 19 when the wire rope 2 is displaced in a side way (indicated by arrows) with respect to the direction of the above magnetic flux B, to detect a displacement degree of the wire rope 2.

Figure 12:
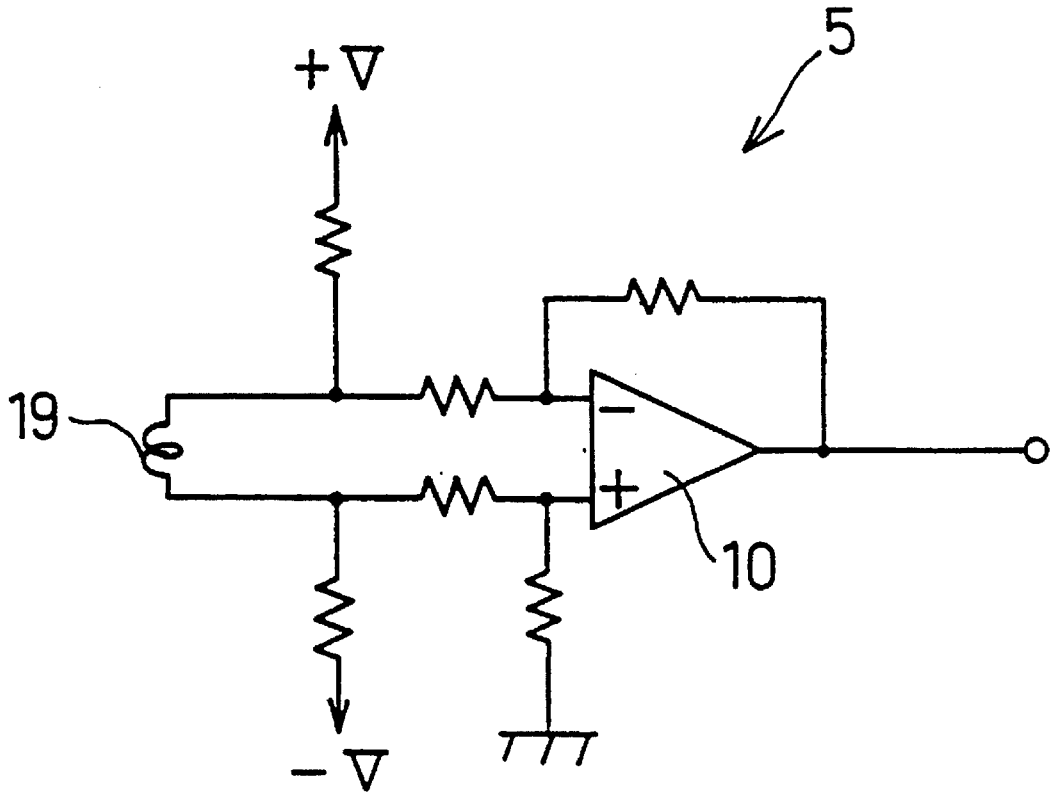
FIG. 12 is a circuit diagram showing a detection circuit using a coil.

The above detection circuit 5 is to amplify the output voltage from the above coil 19. This detection circuit 5 is a common differential amplifying circuit comprising an operation amplifier 10 having both ends of the above coil 19 connected to plus and minus terminals on the input side as shown in FIG. 12, and amplifies a deviation between both ends of the coil 19 due to the induced electromotive force generated in the coil 19. The voltage applied to both ends of the coil 19 is to drive the circuit. Since a change in magnetic flux B is obtained from the induced electromotive force generated in the coil 19, a displacement of the wire rope 2 can be detected, and so the offset cancel part is not required. And, since the coil is used, a sharp displacement of the wire rope 2 due to a gust of wind can be detected at high sensitivity.

Figure 13:
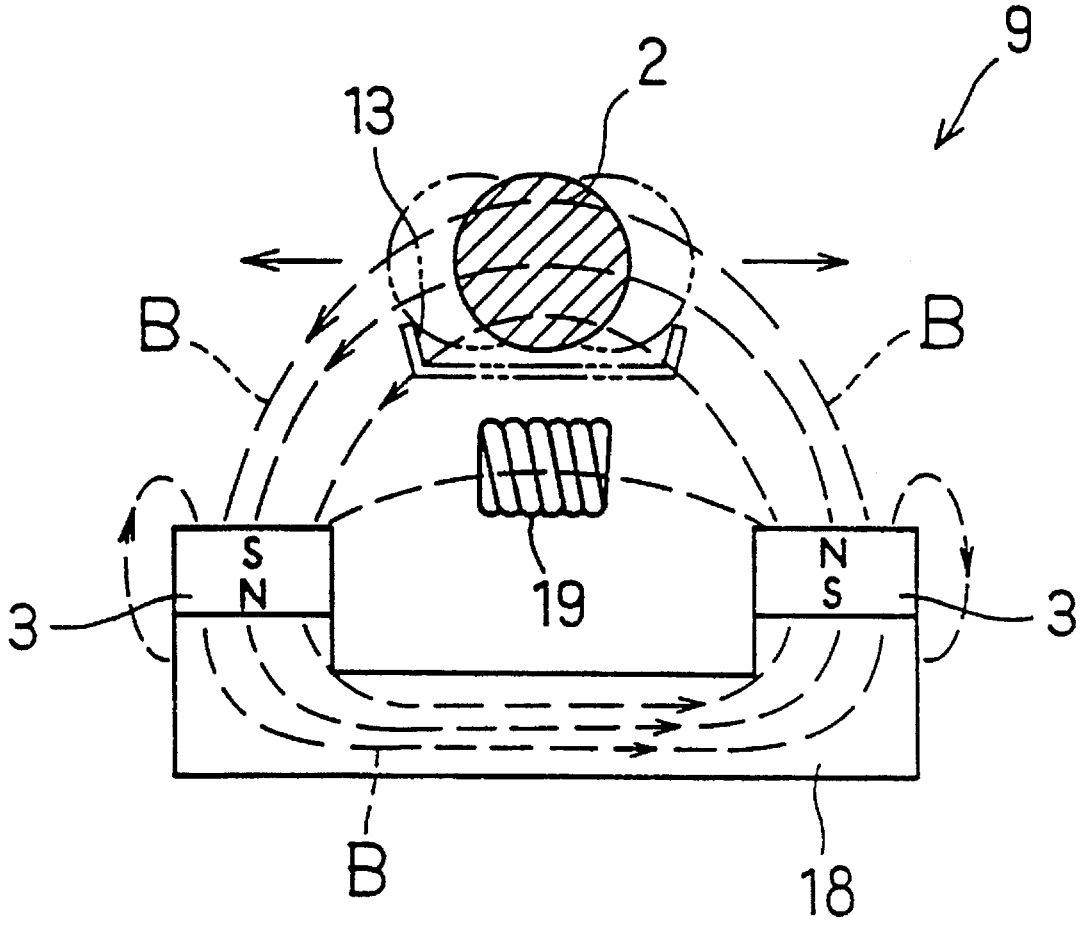
FIG. 13 is a schematic illustration of the displacement detector for the metallic rope in the guide member in a fifth embodiment.

In the displacement detector 1 according to a fifth embodiment shown in FIG. 13, in the same way as the above second embodiment, as compared with the case using a single magnet 3, displacement detecting sensitivity is improved and magnet quantity is decreased, and a displacement direction with respect to the horizontal direction can be specified. The detection circuit 5 is the same as the fourth embodiment.

Figure 14:
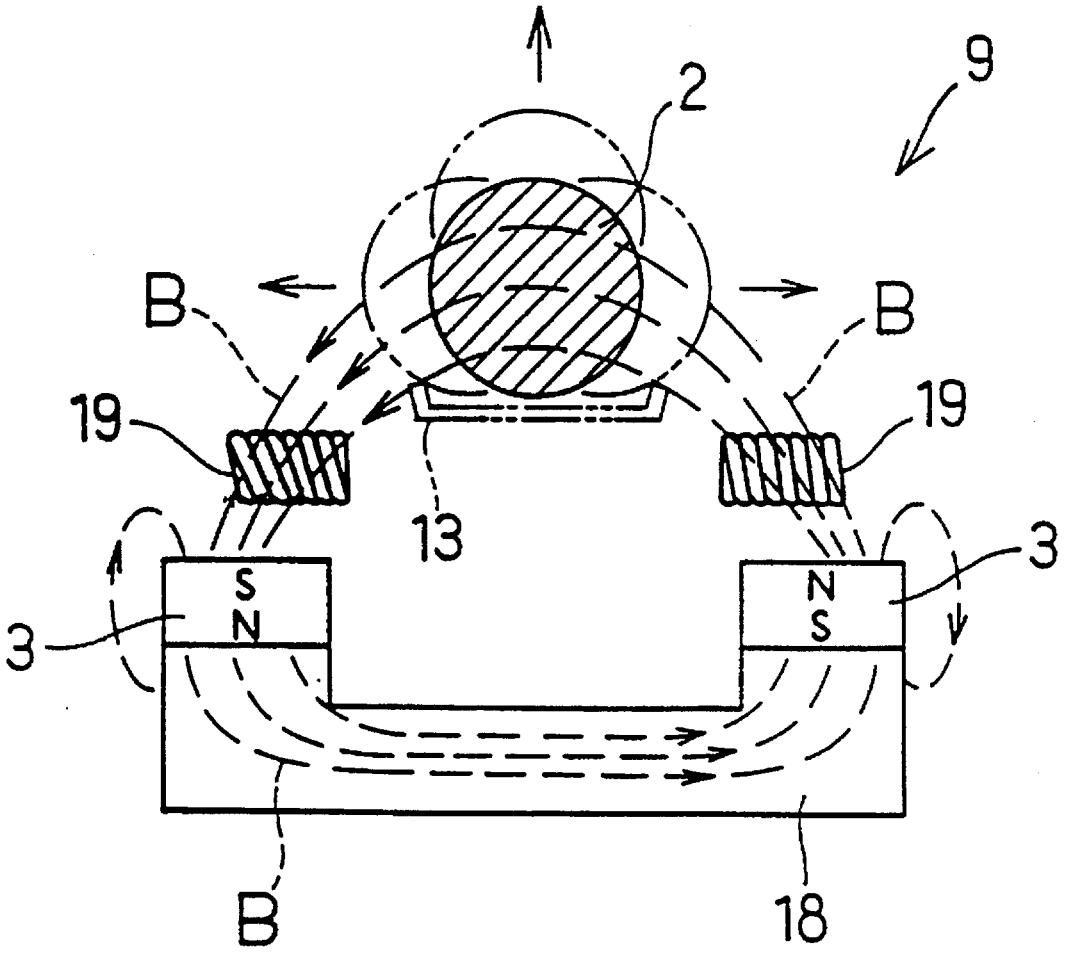
FIG. 14 is a schematic illustration of the displacement detector for the metallic rope in the guide member in a fifth embodiment.

In the displacement detector 1 according to a sixth embodiment shown in FIG. 14, a displacement direction with respect to the vertical direction can be specified separately from the horizontal direction in the same way as in the above third embodiment. But, the offset cancel voltage of FIG. 10 is not required.

Figure 15:
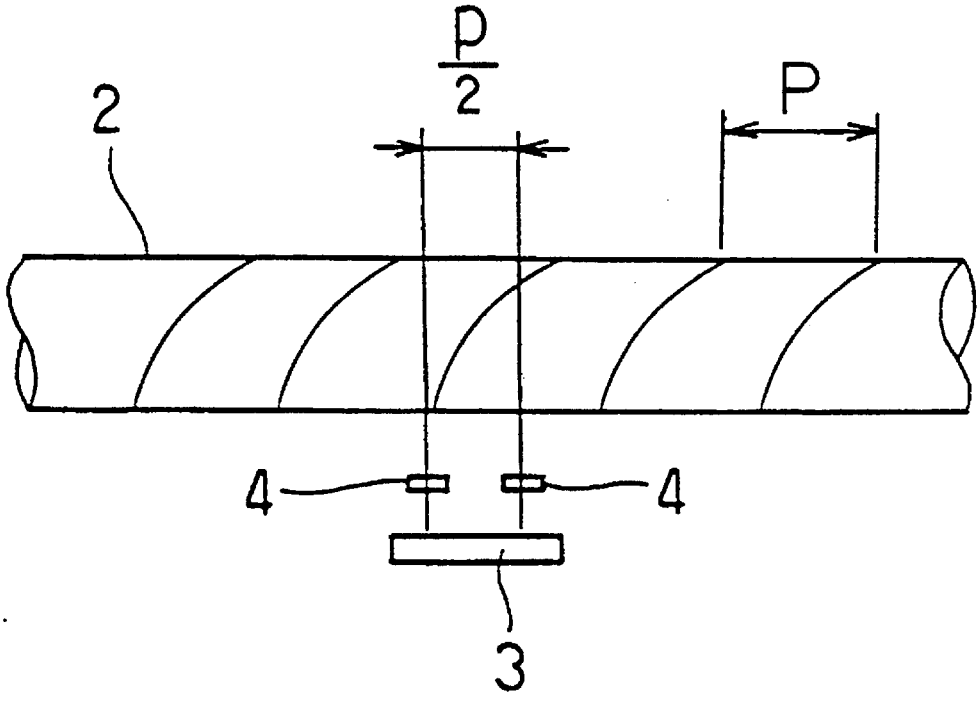
FIG. 15 is a view showing the detection unit corresponding to a lay of the wire rope according to a seventh embodiment.

A seventh embodiment shown in FIG. 15 is a detector using a strand such as the wire rope 2 as the metallic rope. Generally, the wire rope is broadly used for the rope of the ski lift device. Since the wire rope 2 has a lay, detection in the direction of one diameter of the wire rope 2 may be erroneous because of a ripple component contained in the output voltage due to the lay. In other words, even when the wire rope 2 is running with a certain distance kept from the hall element 4, the wire rope 2 is detected as being periodically approached to or separated from the hall element because of the presence of the lay. To prevent this erroneous detection, the magnet 3 and two sets of hall elements 4 are disposed in parallel with an interval of ½ of pitch P of the lay along the axial direction of the wire rope 2 as shown in FIG. 15, and the output voltage from each hall element is synthesized, so that the ripple component can be removed from the output voltage. The detection circuit 5 of this embodiment is structured by connecting the differential amplifying parts 6, 6 connected to the two sets of hall elements 4 and the offset cancel part 7 to the input terminal on the minus side of the inversion amplifying part 8 as shown in FIG. 16. As described above, since the two sets of hall elements 4 are disposed in parallel with an interval of ½ of pitch P of the lay along the axial direction of the wire rope 2, the output voltage having a phase inverted by 180 degrees from each hall element 4 is obtained, and by adding each output voltage, the ripple component is removed. Therefore, without being influenced by the lay of the wire rope 2, a displacement degree can be detected at high accuracy. And, the hall element used in this embodiment may be a coil.

Figure 17:
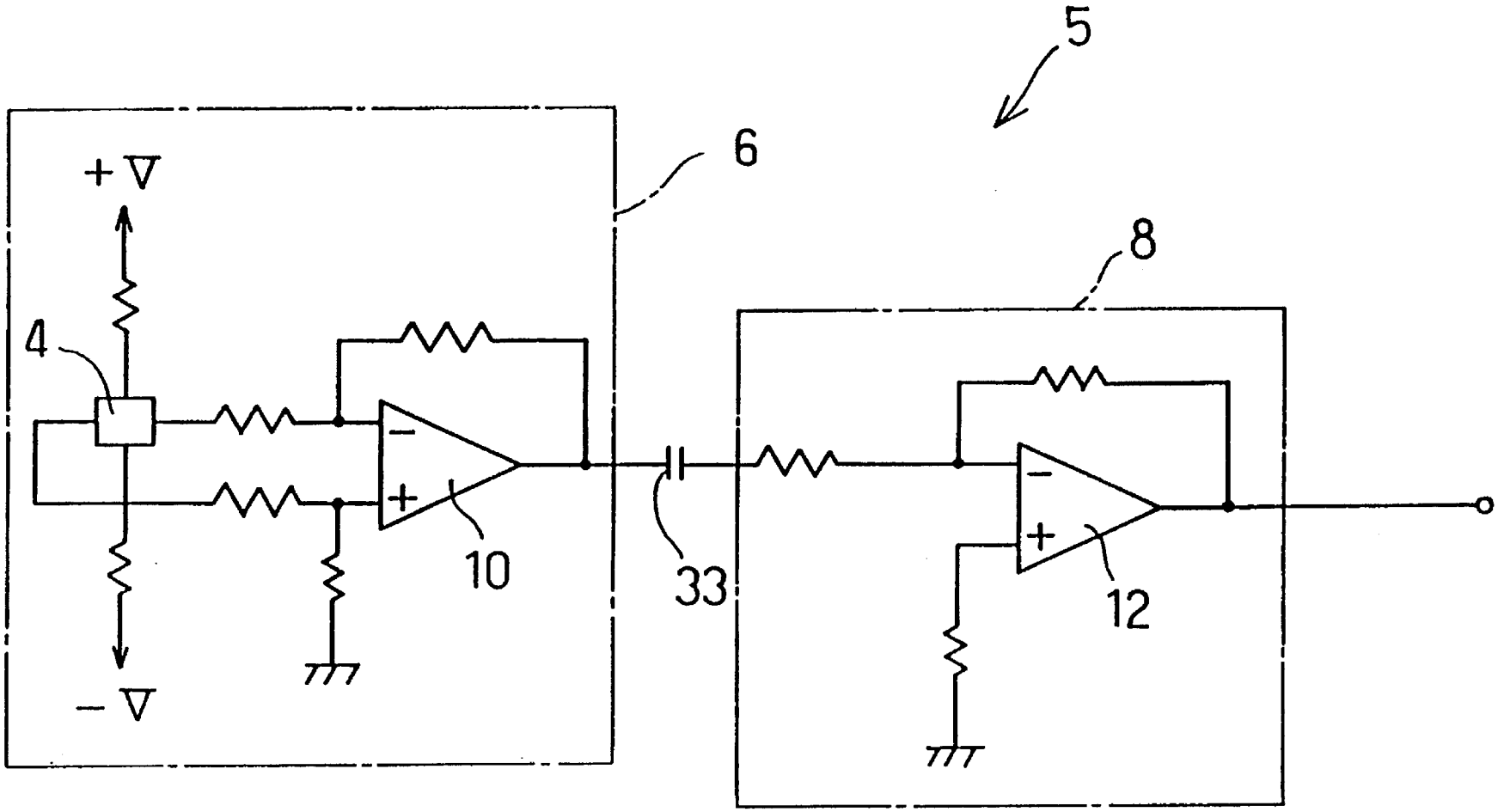
FIG. 17 is a circuit diagram showing the detection circuit using the magnetoelectric conversion element according to an eighth embodiment and not requiring the offset cancel circuit.

The displacement detector 1 according to an eighth embodiment shown in FIG. 17 has the offset cancel part 7 removed from the detection circuit 5 using the magneto-electric conversion element in the above first through third embodiments, and connects a capacitor 33 between the differential amplifying part 6 and the inversion amplifying part 8. Thus, a displacement only of the wire rope 2 can be detected in the same way as in the fourth through sixth embodiment.

According to the first embodiment to the eighth embodiment described above, by a simple structure comprising the magnet, metallic rope, guide member and magnetoelectric conversion element, a displacement degree of the metallic rope, or a displacement degree when the metallic rope is displaced from an optional position which is a standard can be detected, so that the off-position of the wire rope from the pulley's groove can be prevented automatically and efficiently by disposing the detector at a certain position, and this detector can be easily disposed on an existing lift facilities.

Figure 18:
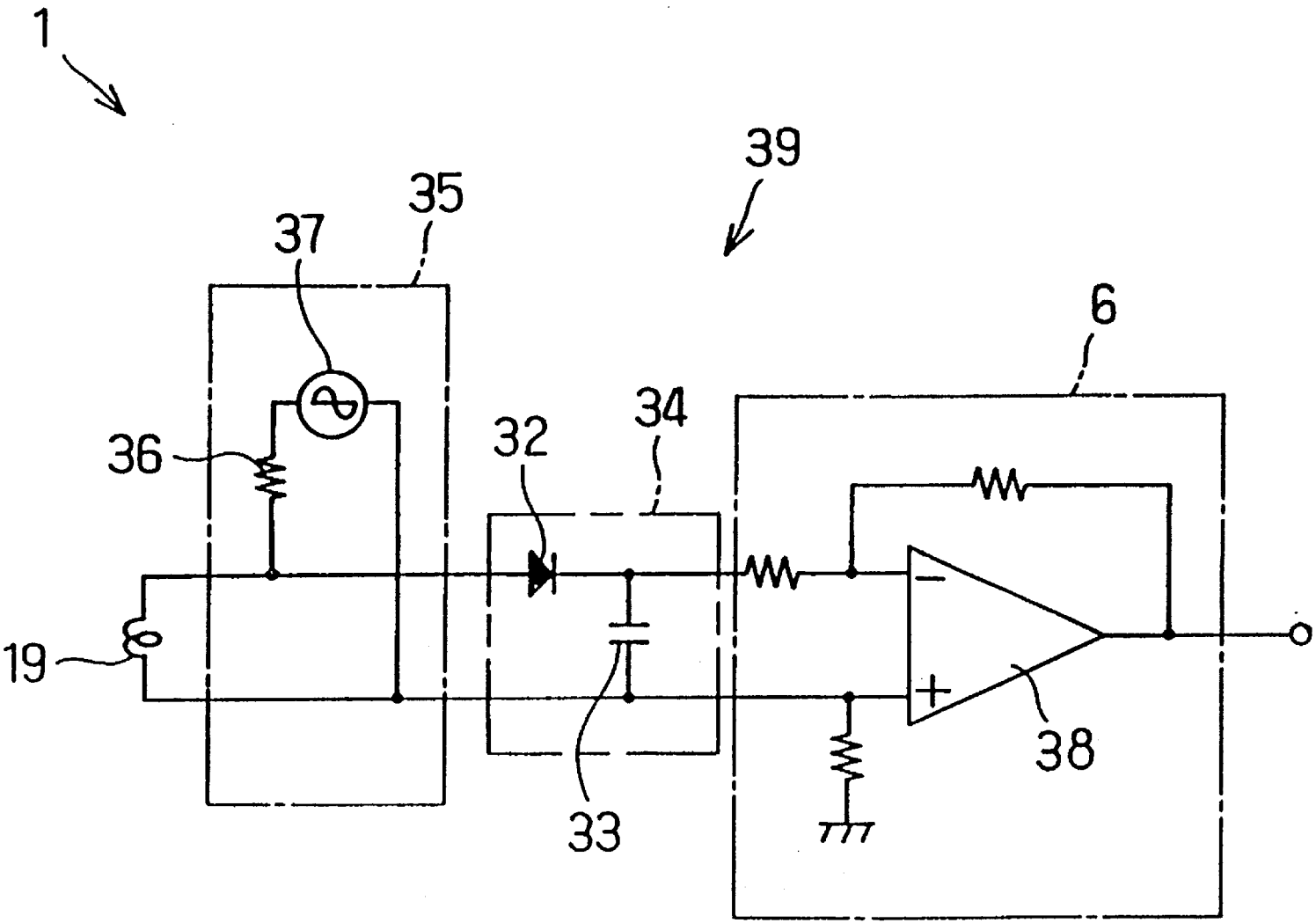
FIG. 18 is a circuit diagram of the displacement detector according to a ninth embodiment.

The displacement detector 1 according to a ninth embodiment shown in FIG. 18 comprises the coil 19 and a detection circuit 39.

The above detection circuit 39 comprises a detection part 35 for detecting an impedance change generated in the coil 19, a rectifying part 34 for rectifying an AC signal into a DC signal, and a differential amplifying part 6 for amplifying the DC signal.

The above detection part 35 comprises a voltage dividing resister 36 connected in series to the coil 19, and an oscillator 37 connected to one end of the voltage dividing resistor 36 as shown in FIG. 18. The above coil 19 has a high-frequency signal applied by the oscillator 37, and when the wire rope 2 is displaced from the standard position and approaches to the coil 19, the inductance of the coil 19 changes, resulting in an impedance change. Accordingly, a voltage dividing ratio of the coil and the voltage dividing resistor 36 changes, and a voltage dividing voltage applied to both ends of the coil is changed.

The above rectifying part 34 is a common smoothing circuit consisting of a diode 32 and a capacitor 33, and a voltage dividing voltage signal generated in the above detecting part 35 is rectified into a DC voltage signal.

The above differential amplifying part 6 is a common differential amplifying circuit which comprises an operation amplifier whose plus and minus terminals on the input side are connected with two output lines from the above rectifying part 34, and a deviation of the DC voltage signal outputted between both output lines is amplified to a certain level and obtained as a displacement degree.

Figure 19:
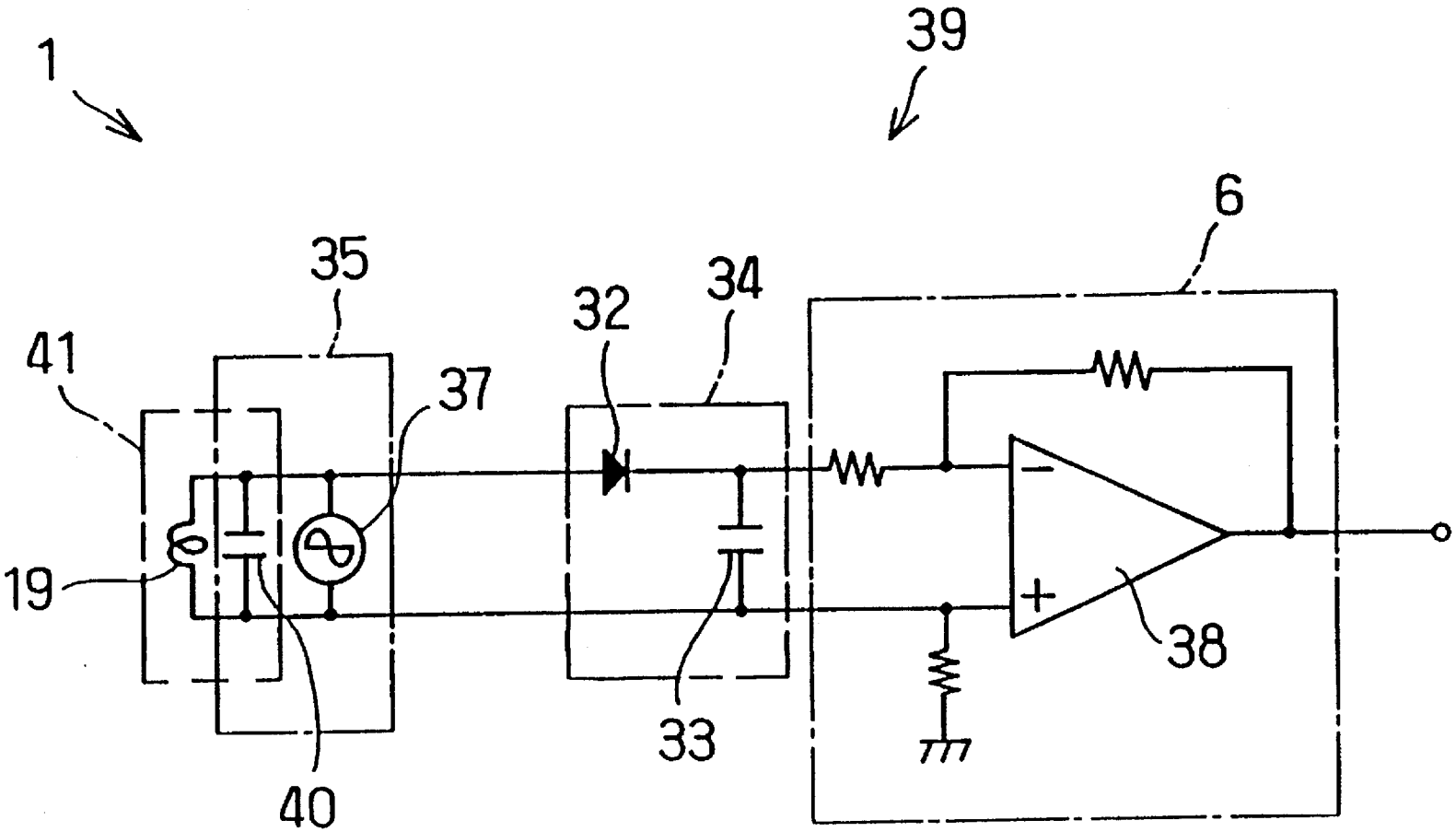
FIG. 19 is a circuit diagram of the displacement detector according to a tenth embodiment.

The displacement detector 1 according to a tenth embodiment shown in FIG. 19 comprises a coil 19 and a detection circuit 39.

The above detection circuit 39 comprises a detection part 35, a rectifying part 34 for rectifying an AC signal into a DC signal, and a differential amplifying part 6 for amplifying the DC signal.

The above detecting part 35 constitutes a resonance circuit 41 by having a capacitor 40 connected in parallel to the above coil 19 as shown in FIG. 19, and constitutes an oscillation circuit by having the oscillator 37 connected in parallel to the resonance circuit 41 (oscillation source) and having the resonance circuit 41 resonated by the oscillator 37. This oscillation circuit is set by the coil 19 and the capacitor 40 so that a certain oscillation characteristic is obtained. And, when the wire rope 2 displaced from the standard position is approached to the coil 19, the leakage flux generated from the coil 19 passes across the wire rope 2. At this time, an eddy current loss is generated within the wire rope 2, and the coil's impedance is changed by this loss. Therefore, a value of quality factor Q of the oscillation circuit is varied, degrading the characteristic as the oscillation circuit.

With the above rectifying part 34, the oscillating output which is changed in the above detection part 35 by a displacement of the wire rope is rectified into a DC voltage signal by the smoothing circuit consisting of the diode 32 and the capacitor 33.

The above differential amplifying part 6 is a common differential amplifying circuit which comprises an operation amplifier whose plus and minus terminals on the input side are connected with two output lines from the above rectifying part 34, and a deviation of the DC voltage signal outputted between both output lines is amplified to a certain level and obtained as a displacement degree.

Figure 20:
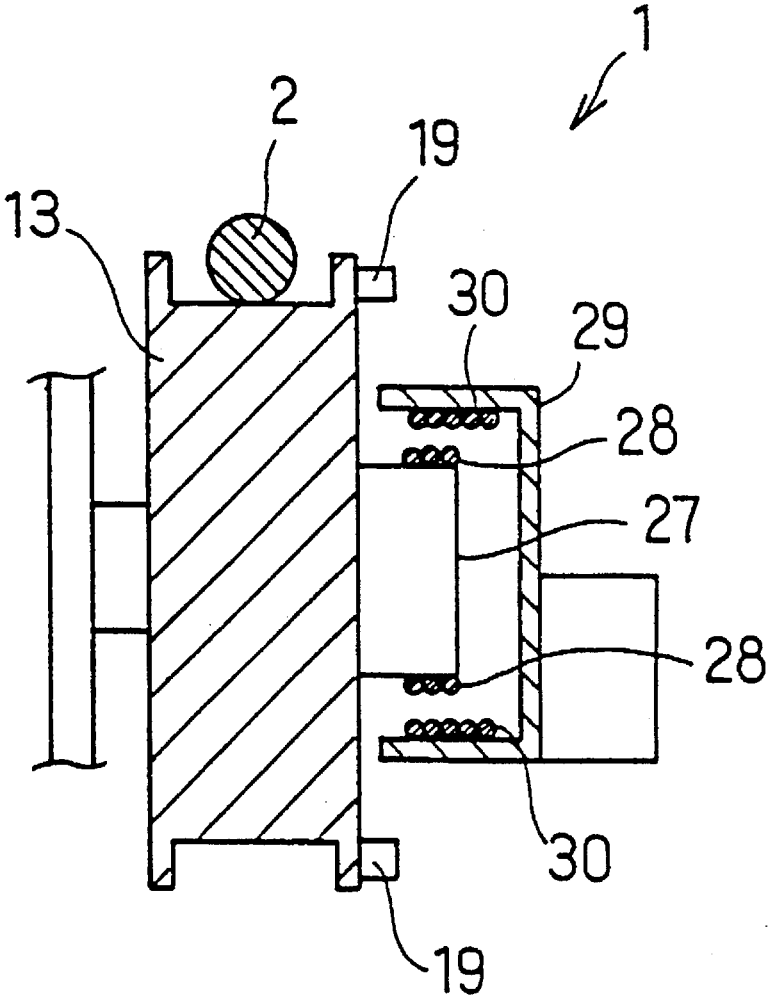
FIG. 20 is a sectional view showing the displacement detector according to an eleventh embodiment.
Figure 21:
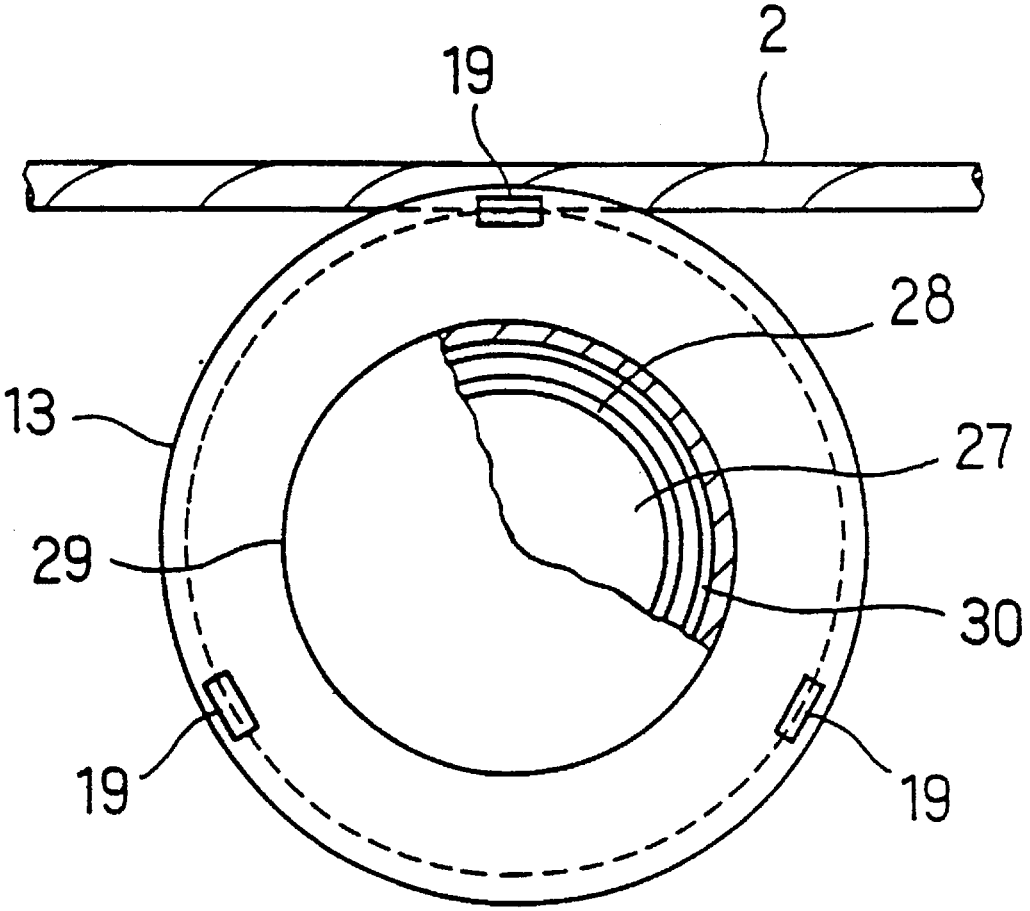
FIG. 21 is a side view showing the above displacement detector.

The displacement detector 1 according to an eleventh embodiment shown in FIG. 20 and FIG. 21 comprises a pulley 13, displacement detecting coils 19, a revolving part 27, a revolving side coil 28, a stationary part 29, a stationary side coil 30, a detecting part 35, a rectifying part 34, and a differential amplifying part 6.

Figure 22:
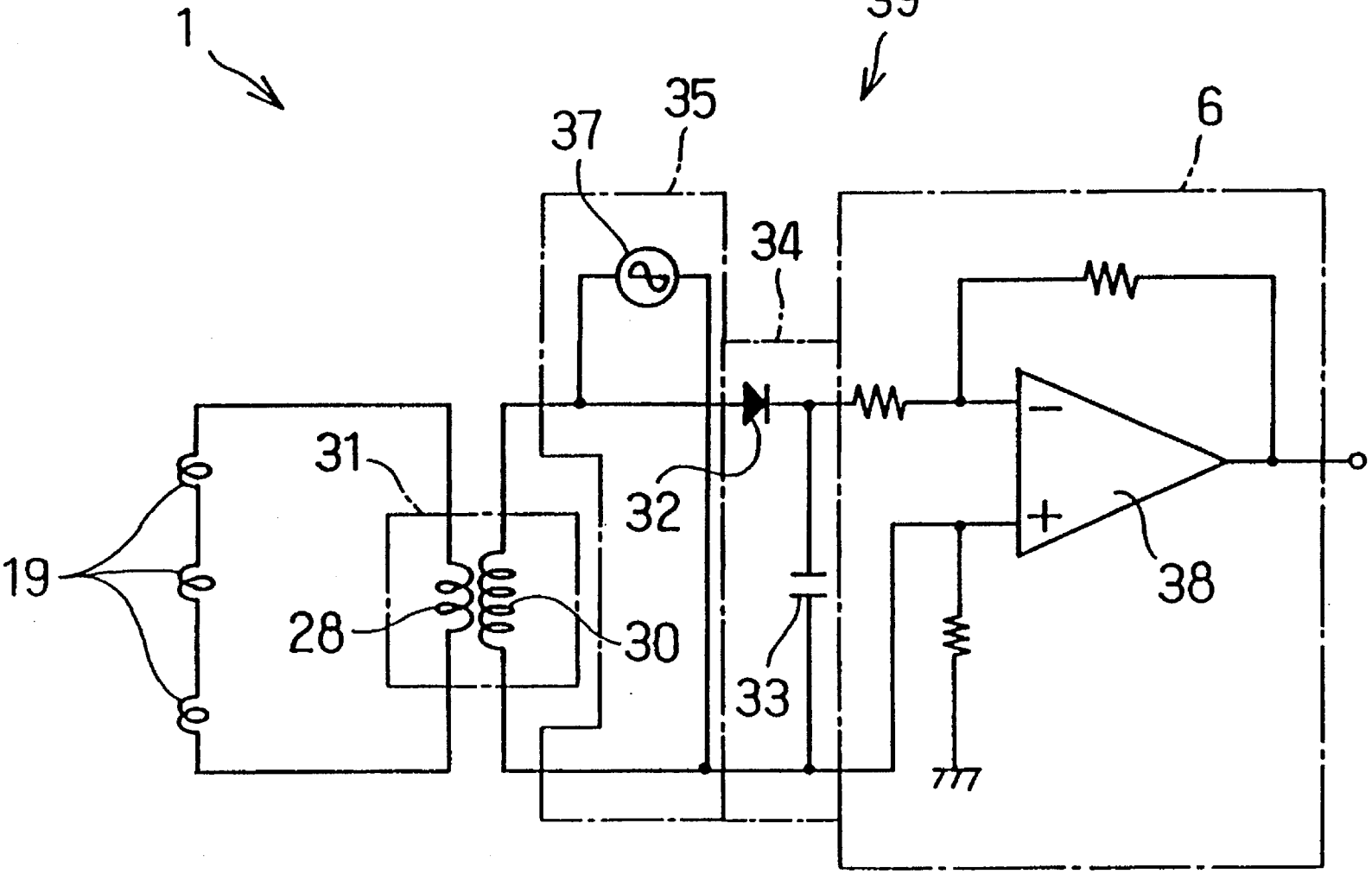
FIG. 22 is a circuit diagram showing the above displacement detector.

The above displacement detecting coils 19 are disposed at an equal interval in the peripheral direction on one side of the pulley 13 as shown in FIG. 21, and each displacement detecting coil is connected to the detecting part 35 via a rotary transformer 31 which consists of the stationary side coil 30 and the revolving side coil 28, to be described afterward, mutually connected in series on the circuit as shown in FIG. 22. In this embodiment, they are disposed at three points at an equal interval in the peripheral direction, but may be disposed in more numbers.

The above revolving part 27 is a small projected part formed coaxially with the pulley 13 on one side of the pulley 13, and the above revolving side coil 28 is wound in certain turns on the outer periphery of the revolving part 27.

The above stationary part 29 is formed in the shape of a cylinder which has a larger diameter than the revolving 27 and whose one end is closed, and the above stationary side coil 30 is wound in certain turns on the inner periphery of the stationary part 29.

The above detecting part 35 comprises the oscillator 37 which is connect in parallel to the above stationary side coil 30 as shown in FIG. 22. The above stationary side coil 30 has a high-frequency signal applied by the oscillator 37, and when the wire rope 2 is displaced from the standard position of displacement to approach to the displacement detecting coil 19, mutual induction is caused between the wire rope 2 and each displacement detecting coil 19, causing an impedance change in each displacement detecting coil 19. A voltage which is applied between both ends of the displacement detecting coil 19 at this time is applied with its voltage changed to both ends of the above stationary side coil 30 via the above rotary transformer 31.

The above rectifying part 34 is connected to both ends of the stationary side coil 30, and a voltage signal which is applied between both ends of the stationary side coil 30 is rectified into a DC voltage signal by the smoothing circuit consisting of the diode 32 and the capacitor 33.

The above differential amplifying part 6 is a common differential amplifying circuit which comprises an operation amplifier 38 whose plus and minus terminals on the input side are connected with two output lines from the above rectifying part 34, and a deviation of the DC voltage signal outputted between both output lines is amplified to a certain level and obtained as a displacement degree.

Therefore, the AC signal by the oscillator 37 is applied to the displacement detecting coil 19 via the rotary transformer 31 consisting of the stationary side coil 30 and the revolving side coil 28, falling in a state supplied. And, when wire rope 2 is displaced from the standard point in the groove of the pulley 13 and approached to the displacement detecting coil 19, the impedance of the displacement detecting coil 19 is changed. Thus, a voltage applied to both ends of the displacement detecting coil 19 is changed, the changed voltage is rectified into a DC voltage in the rectifying part 34 via the rotary transformer 31, and then amplified to a certain level in the differential amplifying part 6 to obtain a displacement degree. In other words, the application of the AC signal to the displacement detecting coil 19 and the detecting of the impedance change of the displacement detecting coil 19 can be made without contacting to the pulley 13.

Figure 23:
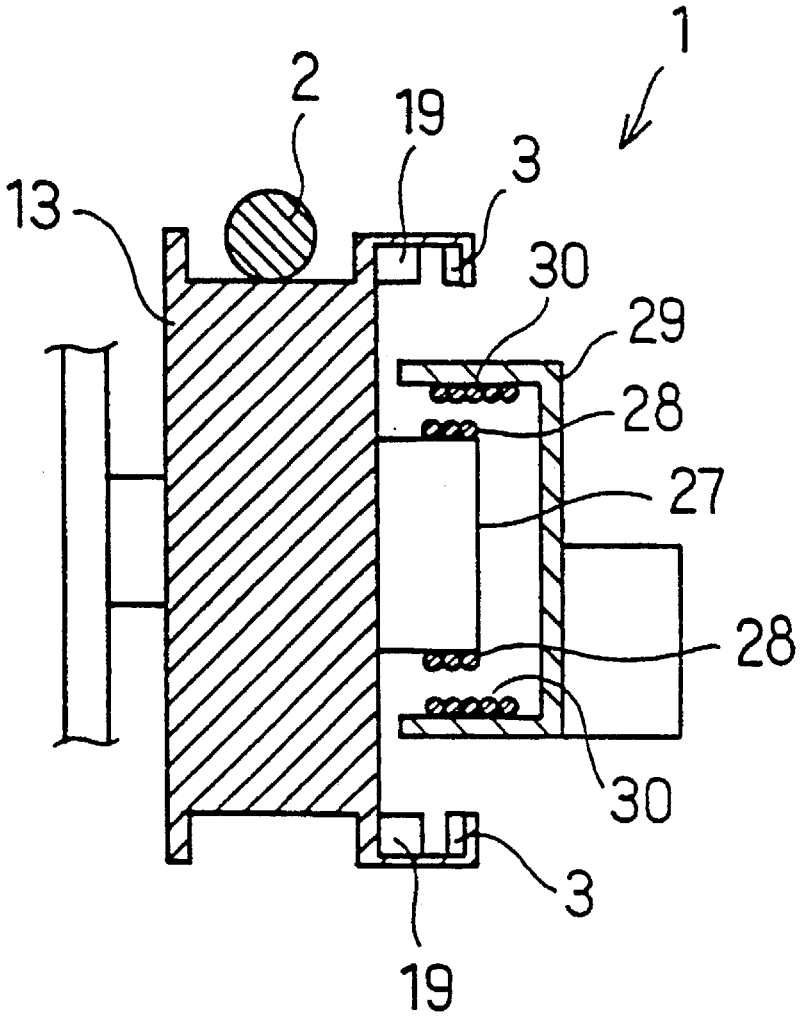
FIG. 23 is a sectional view showing the displacement detector according to a twelfth embodiment.

The displacement detector 1 of a twelfth embodiment shown in FIG. 23 comprises displacement detecting coils 19, magnets 3, a revolving part 27, a revolving side coil 28, a stationary part 29, a stationary side coil 30, a rectifying part 34, and a differential amplifying part 6.

Figure 24:
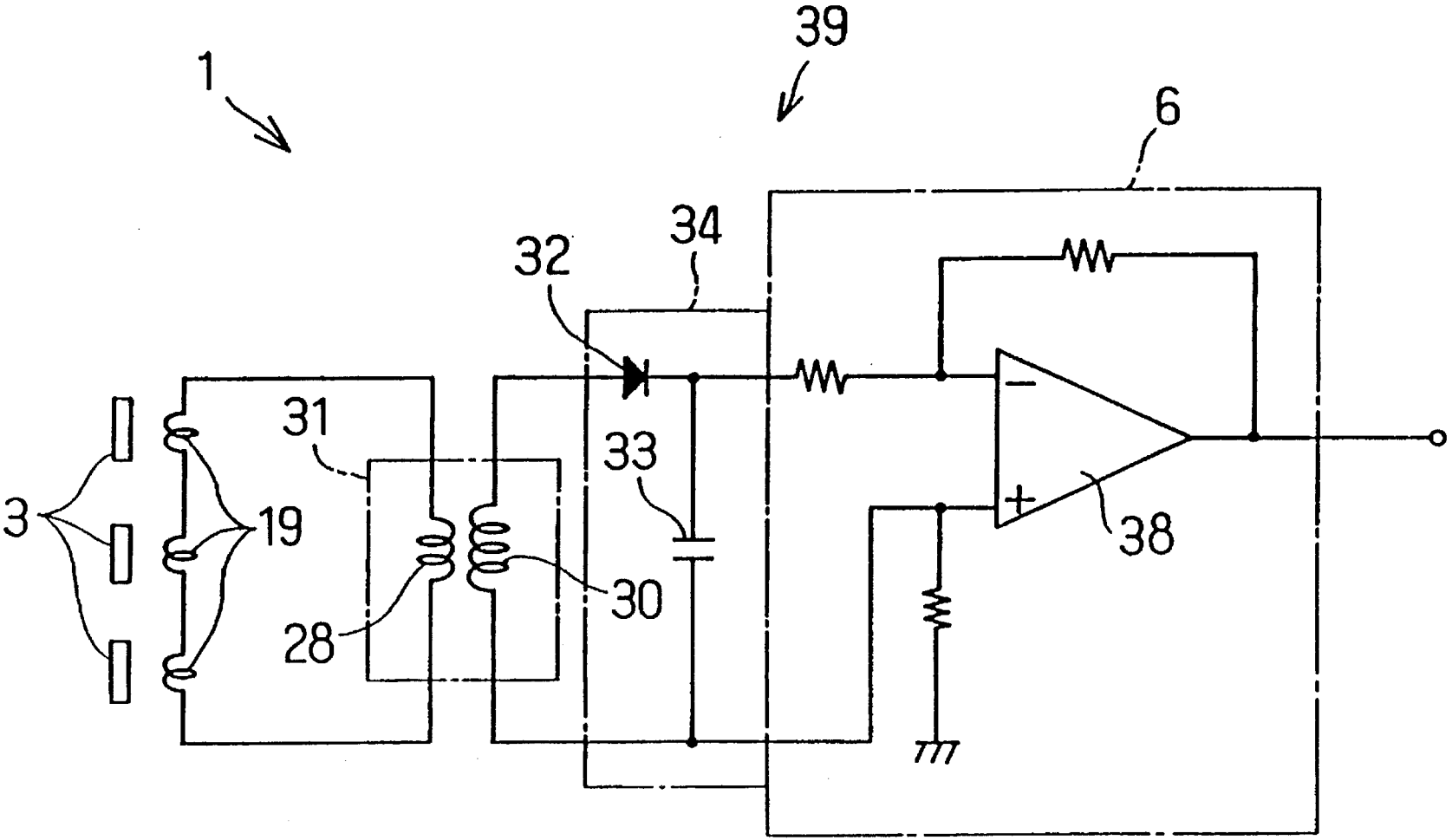
FIG. 24 is a circuit diagram of the above displacement detector.

The above displacement detecting coils 19 are disposed at an equal interval in the peripheral direction on one side of the pulley 13, and each displacement detecting coil 19 is connected in series as shown in FIG. 24. As shown in FIG. 24, both ends of the displacement detecting coil 19 connected in series are connected to the rectifying part 34 via the rotary transformer 31 consisting of the revolving side coil 28 and the stationary side coil 30 to be described afterward. In this embodiment, they are disposed at three points at an equal interval in the peripheral direction.

The above magnets 3 are disposed apart from the displacement detecting 19 on the back of the above displacement detecting coil 19 far from the pulley's groove as shown in FIG. 23. These magnets 3 are to form magnetic flux B which is generated from N pole and passes across the wire rope 2.

The above revolving part 27 is a small projected part formed coaxially with the pulley 13 on one side of the pulley 13, and the above revolving side coil 28 is wound in certain turns on the outer periphery of the revolving part 27.

The above stationary part 29 is formed in the shape of a cylinder which has a larger diameter than the revolving part 27 and whose one end is closed, and the above stationary side coil 30 is wound in certain turns on the inner periphery of the stationary part 29.

The above rectifying part 34 is connected to both ends of the stationary side coil 30 as shown in FIG. 24, and a voltage signal due to an induced electromotive force generated in the above revolving side coil 28 is rectified into a DC voltage signal by the smoothing circuit consisting of the diode 32 and the capacitor 33.

The above differential amplifying part 6 is a common differential amplifying circuit which comprises an operation amplifier 38 whose plus and minus terminals on the input side are connected with two output lines from the above rectifying part 34 as shown in FIG. 24, and a deviation of the DC voltage signal outputted between both output lines is amplified to a certain level and obtained as a displacement degree.

Therefore, when wire rope is displaced from the standard point in the groove of the pulley and approached to the displacement detecting coil, magnetic flux B interlinking with the coil is changed, causing an induced electromotive force in the coil. Thus, a voltage applied to both ends of the displacement detecting coil 19 is changed, the changed voltage is rectified into a DC voltage in the rectifying part via the rotary transformer again, and then amplified to a certain level in the differential amplifying part to obtain a displacement degree. In other words, the detecting of the induced electromotive force generated in the displacement detecting coil 19 can be made without contacting to the pulley 13.

Figure 25:
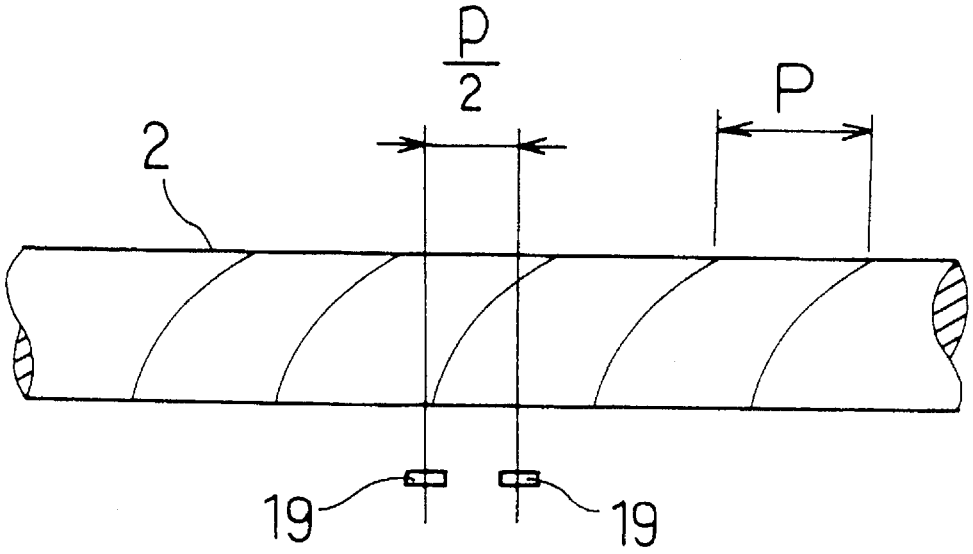
FIG. 25 is a view showing the detection unit corresponding to a lay of the wire rope according to a seventh embodiment.

The displacement detector 1 according to a thirteenth embodiment shown in FIG. 25 is a detector using a strand such as the wire rope 2 as the metallic rope in the same way as in the seventh embodiment. In this embodiment, two sets of coils 19 and the magnet 3 are disposed in parallel with an interval of ½ of pitch P of the lay along the axial direction of the wire rope 2 as shown in FIG. 25, and the output voltage from each coil 19 is synthesized, so that the ripple component can be removed from the output voltage. In other words, the output voltage having a phase inverted by 180 degrees from each coil 19 is obtained, and by adding each output voltage, the ripple component can be removed, so that without being influenced by the lay of the wire rope 2, a displacement degree can be detected at high accuracy.

Figure 26:
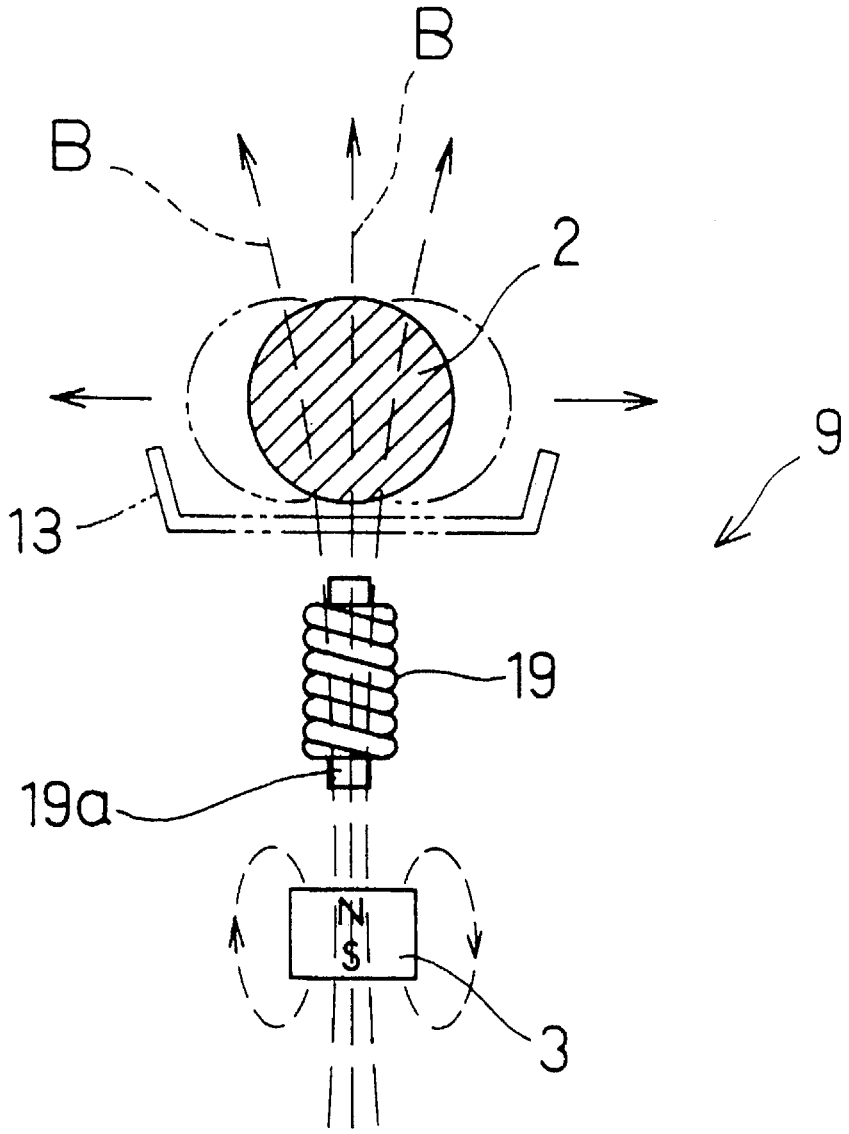
FIG. 26 is a schematic illustration of the displacement detector showing the fourteenth embodiment.
Figure 27:
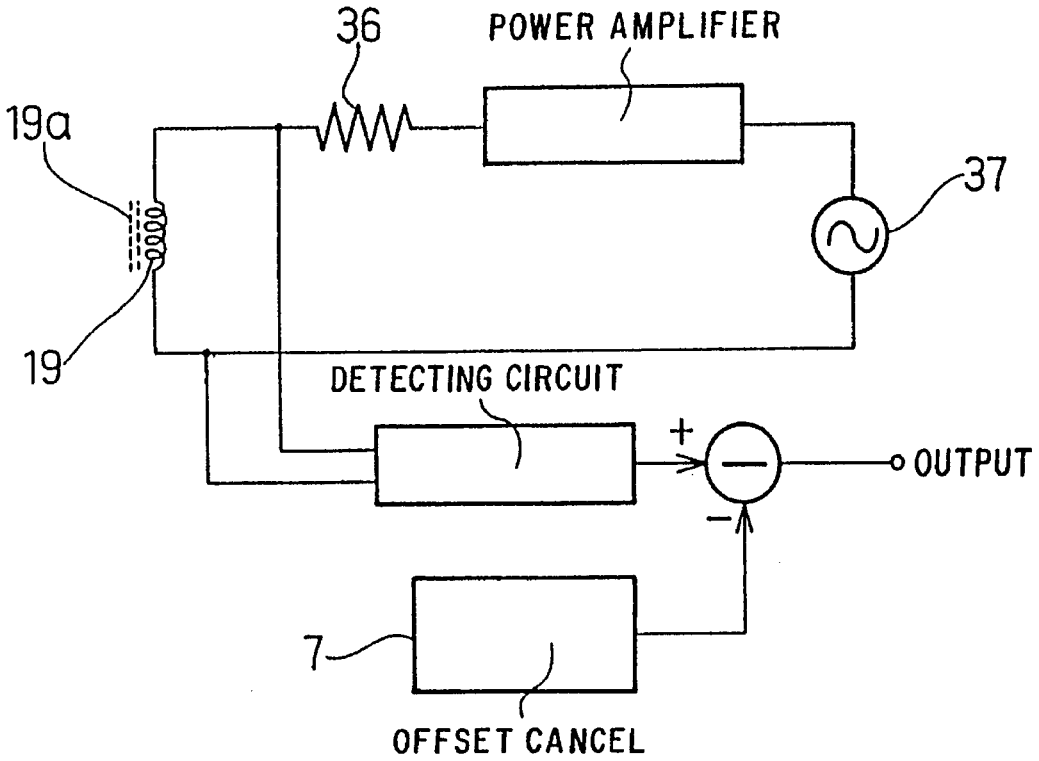
FIG. 27 is a block diagram showing the above displacement detector.

In a fourteenth embodiment shown in FIG. 26 and FIG. 27, the rope is a wire rope 2 made of a magnetic substance, a magnetic 3 is disposed to oppose the wire rope 2, a coil 19 is disposed on a magnetic circuit 9 formed by the magnet 3 and the wire rope 2, a core 19*a* made of a ferromagnetic substance is inserted in the coil, a fixed resistor 36 is connected in series to the coil 19, a constant-frequency signal from the oscillator 37 is applied to the coil 19, and a DC voltage of both ends of the coil is detected, to detect a displacement degree of the wire rope from the pulley.

This embodiment is based on the knowledge that the impedance of the coil 19 changes in proportion to the permeability of the core 19*a* of a ferromagnetic substance. The permeability of the core 19*a* of a ferromagnetic substance changes when the saturated state of the core 19*a* of a ferromagnetic substance changes by a change in magnetic flux of the magnetic circuit 9. And, the magnetic flux of the magnetic circuit 9 changes when a distance between the wire rope 2 and the coil 19 changes. Therefore, a displacement of the wire rope 2 is represented by an impedance change of the coil 19, so that a displacement of the wire rope 2 can be detected by detecting an impedance change of the coil 19.

Specifically, as shown in FIG. 27, an AC signal is applied to detect an impedance change of the coil 19, to detect (DC voltage) a voltage dividing segment with the fixed resistance 36, and to maintain this detection reliability, it is necessary to keep the core 19*a* of a ferromagnetic substance in a saturated state on one hand, and to make a magnetomotive force N. I (ampere turn) by a current flown in the coil 19 well smaller than a DC magnetic field on the other hand. A power amplifying part is disposed between the oscillator 37 and the fixed resistor 36, and since a DC segment of the low-frequency signal detected in the detection circuit generates on offset, it is adjusted by the offset cancel part 7.

Figure 28:
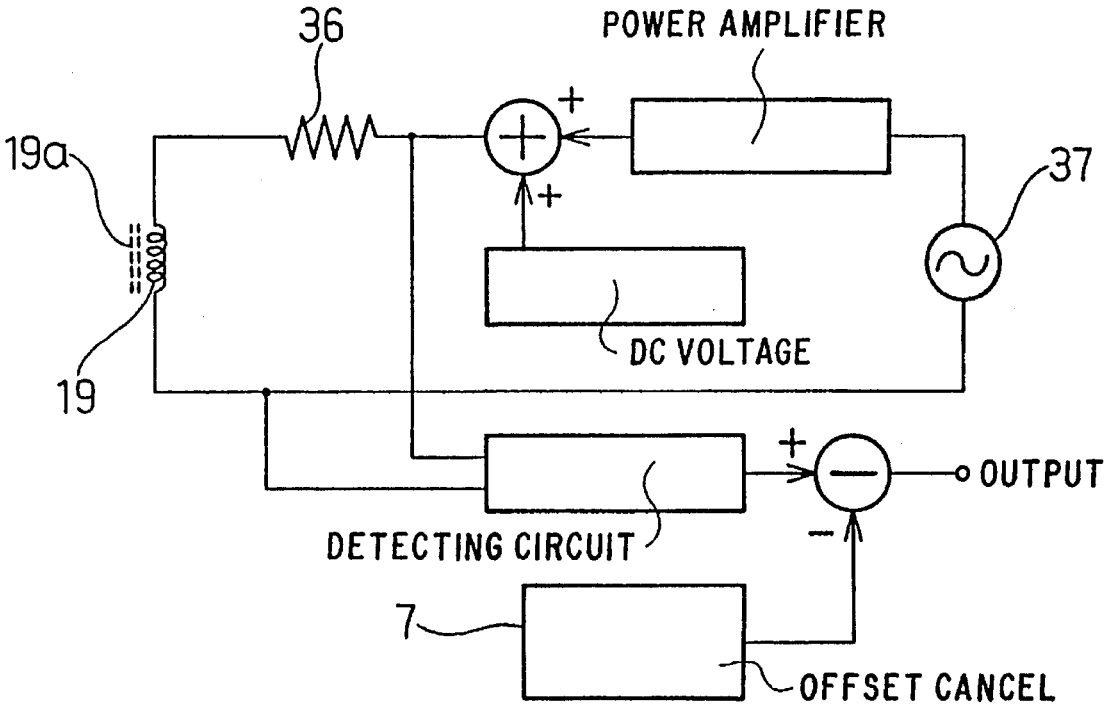
FIG. 28 is a block diagram showing a fifteenth embodiment.

A fifteenth embodiment shown in FIG. 28 applies a DC voltage to the coil 19 without using the magnet 3 which is a permanent magnet to effect the same operation as the magnet 3. In this embodiment, the same operation as above is effected but, since the permanent magnet is not used, the number of parts is decreased, and by adjusting a DC voltage as desired, the generated magnetic force (performance of the magnet generated by applying a DC voltage) can be changed, a detection sensitivity can be easily changed, and as a result, it can be easily applies to various wire ropes. Furthermore, in this embodiment, since magnetic field is generated in the coil by applying a DC voltage, it is necessary to make the magnetomotive force N. I (ampere turn) due to an electric current flowing in the coil 19 equal to or greater than the DC magnetic field.

In the ninth to fifteenth embodiments described above, a displacement degree when the metallic rope is displaced from the standard position within the groove can be detected by an impedance change generated in the coil, so that the construction of the detector is simple, and the off-position of the wire rope from the pulley's groove can be prevented automatically and efficiently. Furthermore, it can be easily mounted on existing lift facilities. And, by constructing the transformer by the revolving side coil and the stationary side coil (ninth and thirteenth embodiments), feeding to the detecting coil disposed on the revolving side and incorporation of a voltage signal can be made without contacting to the pulley, so that a displacement degree can be detected stably at high accuracy without being influenced by the looseness of the pulley axially supported in the process of detecting the displacement degree.

Figure 29:
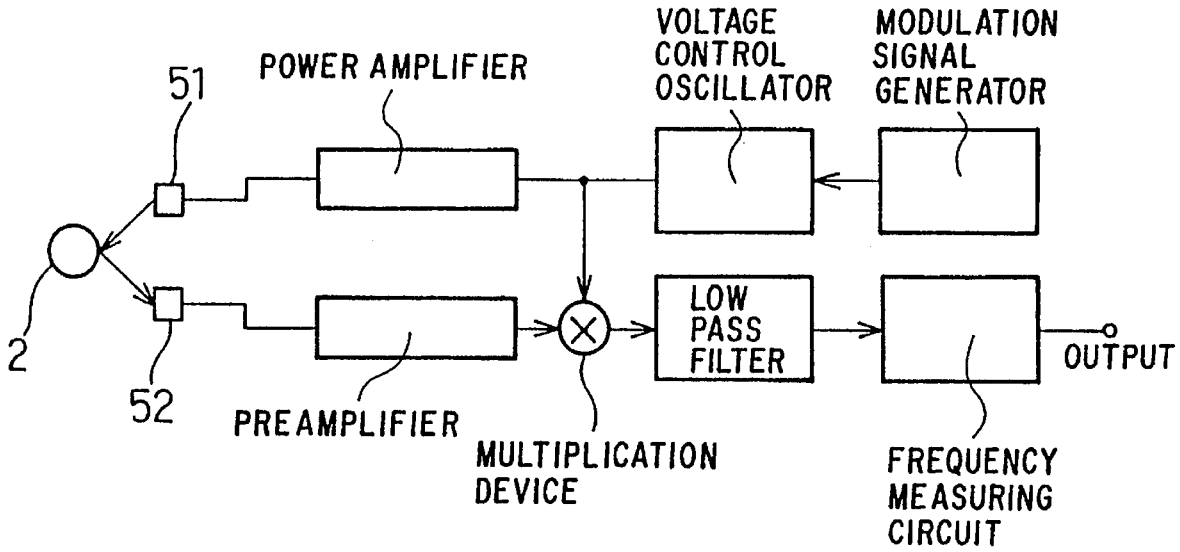
FIG. 29 is a block diagram showing a sixteenth embodiment.

A sixteenth embodiment shown in FIG. 29 uses an ultrasonic wave for a displacement detecting medium which is emitted toward the rope 2, the ultrasonic wave sent to the rope by an ultrasonic wave oscillator 51 for sending is reflected from the rope, the reflected ultrasonic wave is received by an ultrasonic wave oscillator 52 for receiving the wave, the sent wave signal is multiplied by the received wave signal obtained a delay time t later, and a displacement degree of a positional change of the rope with respect to the pulley is detected by measuring the frequency. In this embodiment, a frequency modulation and continuous wave method (FM-CW method) has been employed.

More specifically, a continuous wave (transmitted wave) whose frequency is modulated by a modulation signal generator and a voltage control oscillator is used to transmit a wave from the ultrasonic wave oscillator 51 to the rope 2. And, by reflecting from the rope, a received wave obtained a delay time t later is multiplied with a transmitted wave signal to take out a low frequency component alone by a low pass filter so as to obtain an output change according to a displacement. Thus, a displacement degree of the rope from the pulley can be detected.

Figure 30:
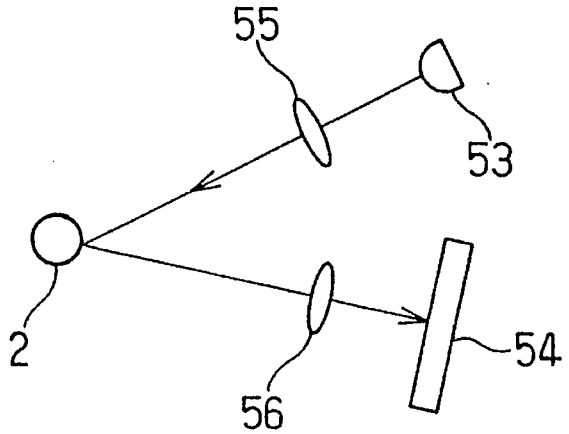
FIG. 30 is a schematic illustration showing a seventeenth embodiment.

A seventeenth embodiment shown in FIG. 30 uses light as a medium for detecting a position which is emitted toward the rope 2, the light emitted from a floodlight element 53 toward the rope is reflected from the rope 2, the reflected light is received by a light receiving element 54, and by a change of the output signal from this light receiving element 54, a displacement degree of the rope 2 from the pulley is detected.

Specifically, light emitted from the floodlight element (for example, a light emitting diode) is finely reduced through a floodlight lens 55 and irradiated to the rope 2. The light reflected from the rope 2 is converged on a light receiving lens 56, and forms an image on the light receiving element (for example, a phototransistor array). And, the position and intensity of irradiation on the light receiving element are changed because an image-formed position varies according to a displacement of the rope, and according to the change of the output signal of the light receiving element, a displacement degree of the rope from the pulley is detected.

According to the sixteenth and seventeenth embodiments described above, since a displacement degree of the rope from the standard position within the groove can be detected based on a change of a medium other than magnetism, even if the rope is not metallic, the off-position of the rope from the pulley's groove can be prevented automatically and efficiently, and the installment to existing lift facilities is easy.

Figure 31:
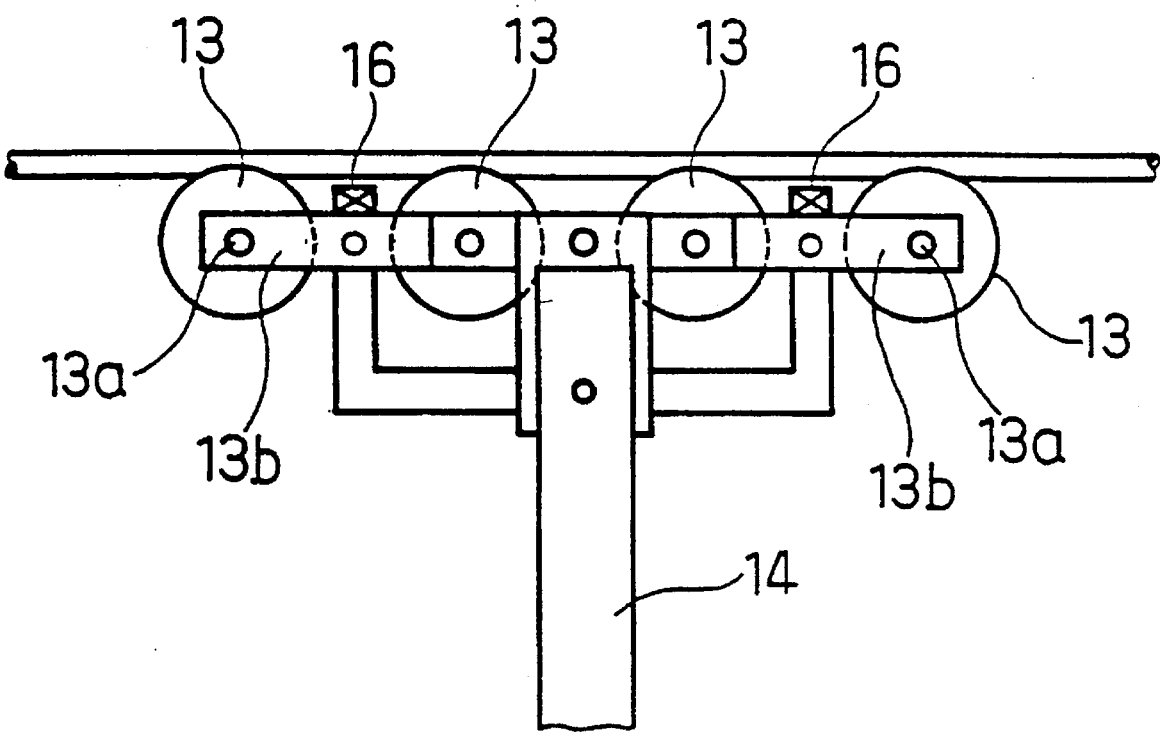
FIG. 31 is a front view showing the displacement detector attached to the pole of a ski lift.

A shown in FIG. 6, the displacement detector is positioned outside of the pulley 13 as the detection unit 16, and as shown in FIG. 31, when the four pulleys 13 are arranged for example, the detector may be disposed between the outer and inner pulleys.

Now, a lift drive control device for controlling a speed by using the above displacement detector will be described.

Figure 32:
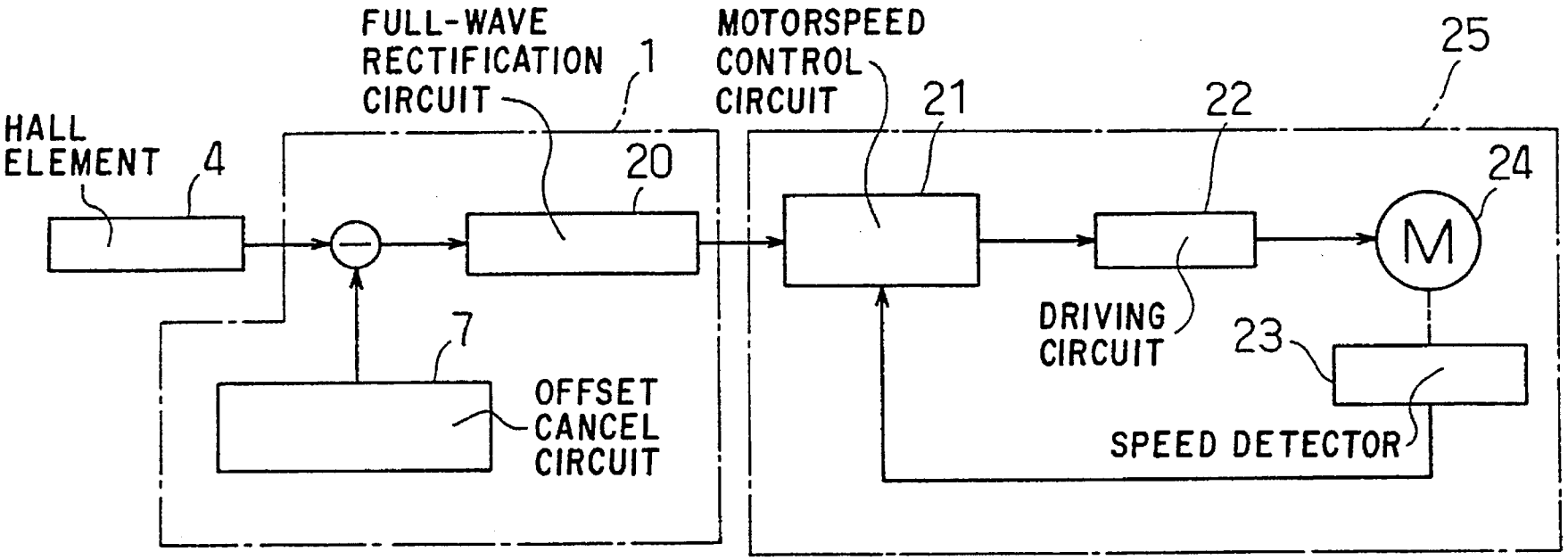
FIG. 32 is a block diagram of the lift drive controlling device according to this invention.

A drive control device for a transfer member such as a lift in this embodiment comprises using the displacement detector illustrated in the first embodiment through the eighth embodiment, and as shown in FIG. 32, consists of the displacement detecting means 1 for detecting a displacement degree of the wire rope from the pulley's groove, and a speed control means 25 for controlling a drive speed of the wire rope according to the output signal from the displacement detecting means 1. Now, the speed control means 25 will be described.

The above speed control means 25 comprises a motor speed control circuit 21, a driving circuit 22, a motor 24, and a speed detector 23 as shown in FIG. 32.

Figure 33:
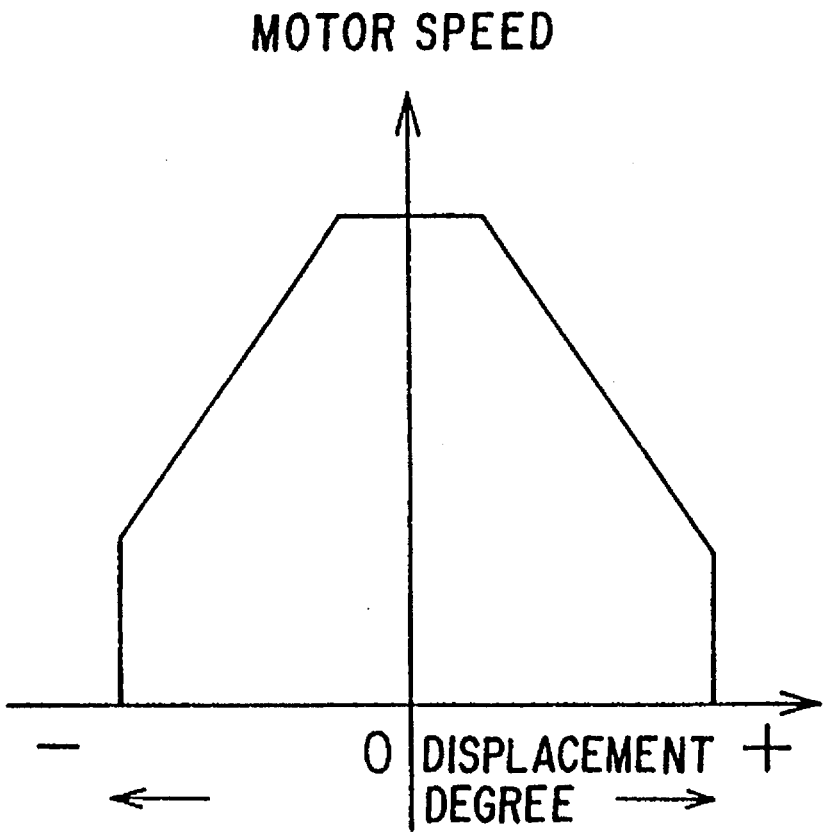
FIG. 33 is a view showing the control of a motor speed with respect to the displacement degree.

The above motor speed control circuit 21 controls the motor speed as shown in FIG. 33 according to the output signal from the above displacement detecting means 1. As shown in the figure, when a displacement degree exceeds a certain level, the motor 24 is braked, while when a displacement degree is small, the motor 24 is operated at a high speed constantly without being varied. Thus, the safety and carrying capacity of the lift can be improved sharply.

The above driving circuit 22 starts or brakes the motor 24, or increases or decreases its speed according to the control signal from the above motor speed control circuit 21.

The above speed detector 23 detect the present speed from the motor 24 and feeds back the detected result to the above motor speed control circuit 21, and the motor speed control circuit 21 compares and judges if the revolving speed of the motor 24 is made under a prescribed control from that signal, and outputs the control signal to the above driving circuit 22, if necessary.

Figure 34:
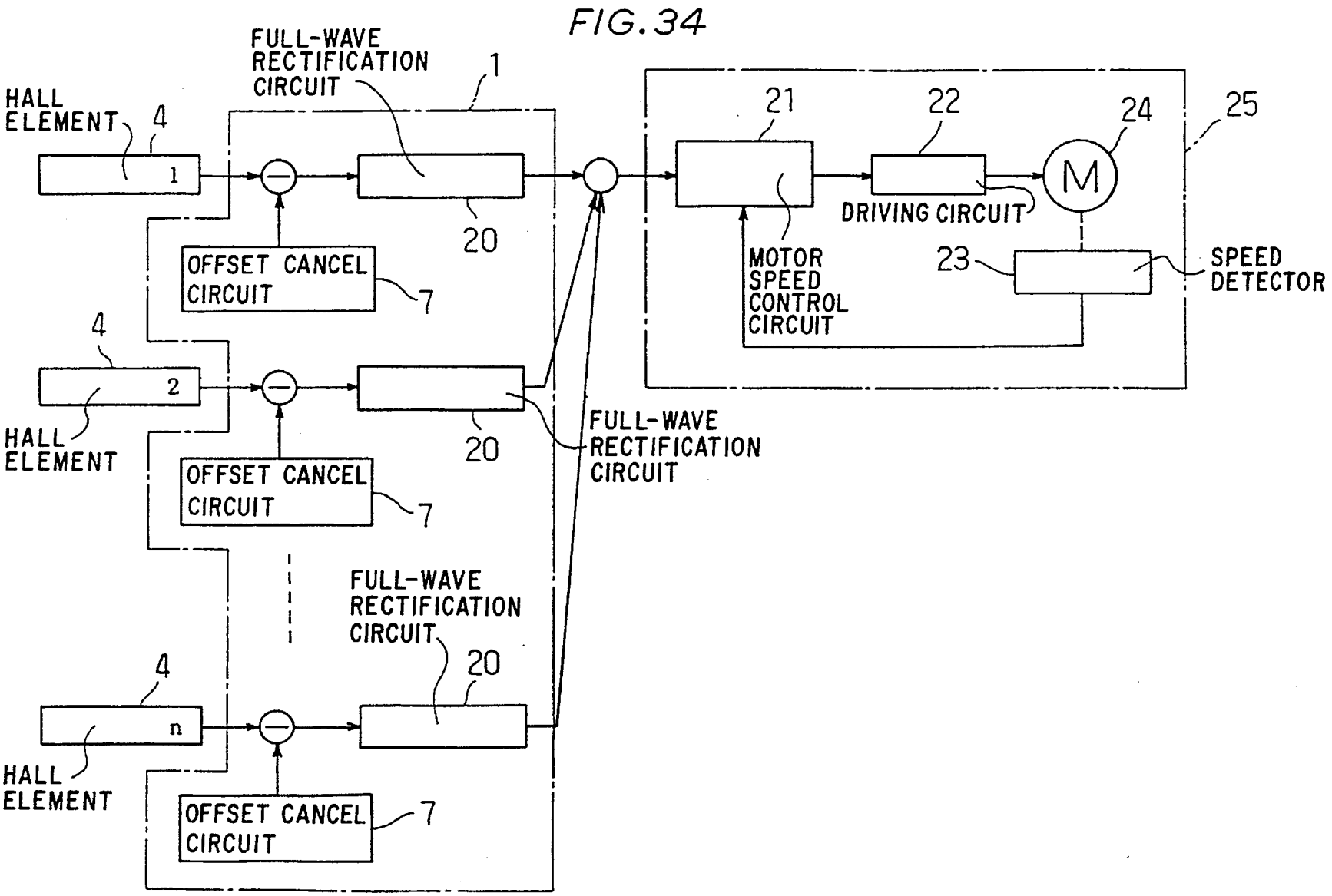
FIG. 34 is a schematic illustration showing the entire lift drive controlling device.

In the lift device constructed as described above, the safety and carrying capacity of the lift can be synthetically improved by taking the output signal due to the detection of a displacement degree from a plurality of pulleys as a logical sum into the above motor speed control circuit 21 as shown in FIG. 34. The standard position of displacement is optional.

Figure 35:
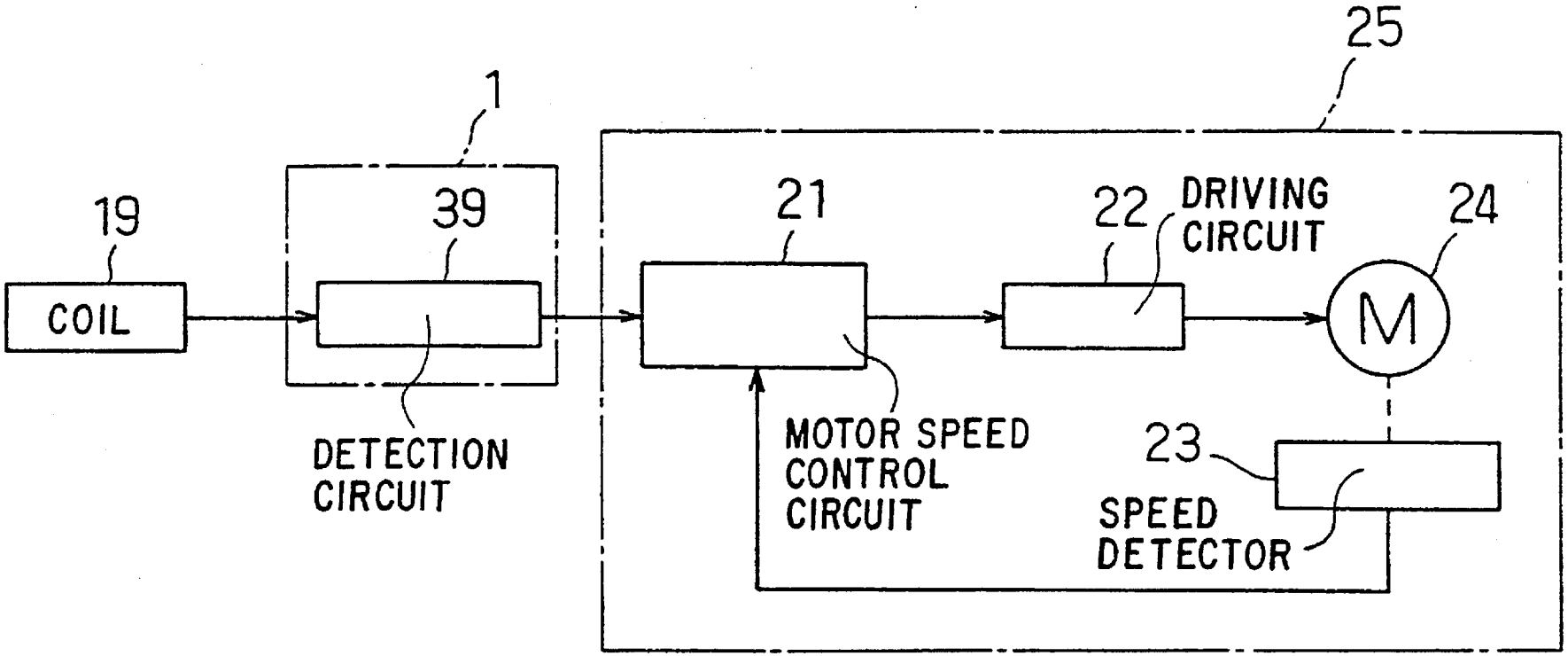
FIG. 35 is a block diagram of the lift drive controlling device of another embodiment.
Figure 36:
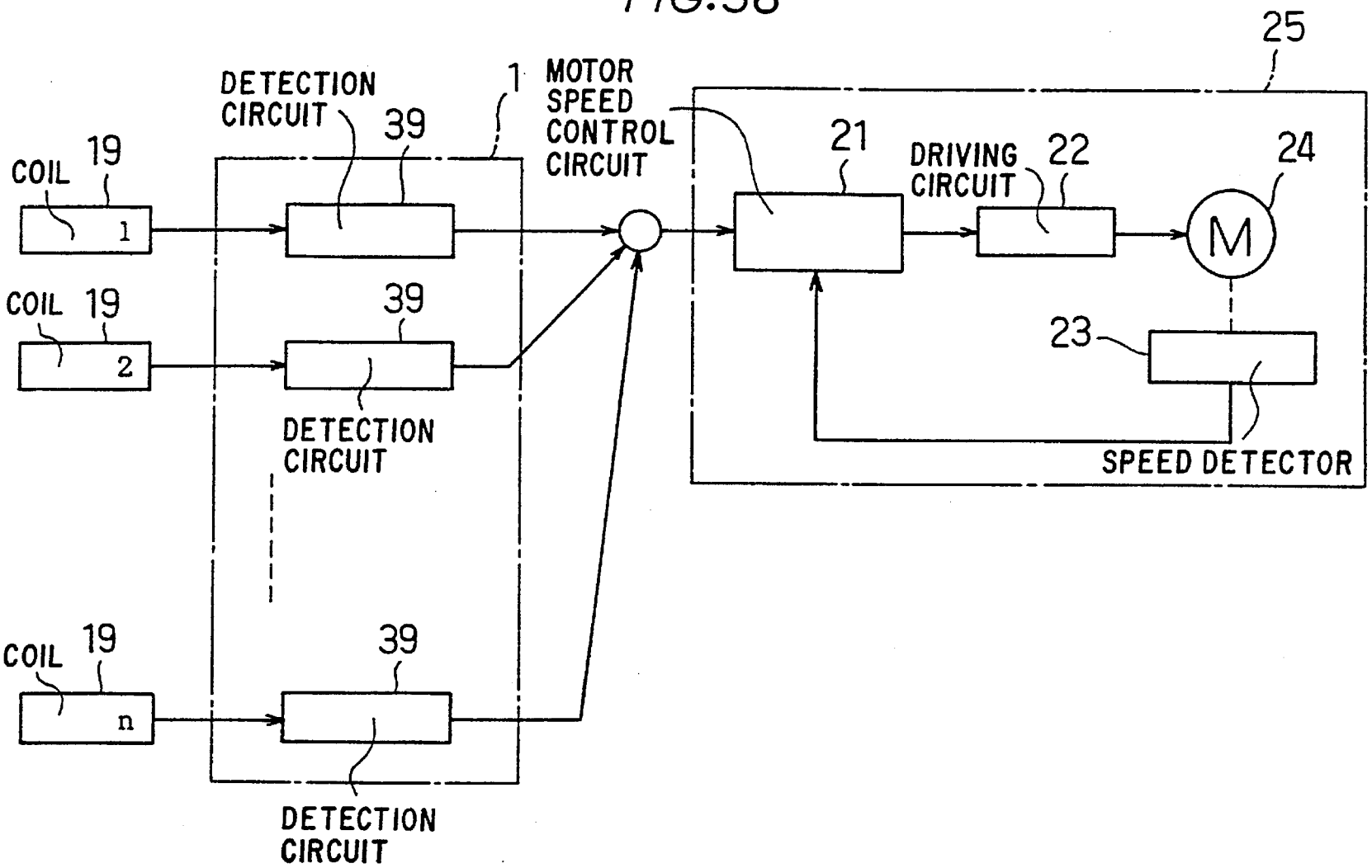
FIG. 36 is a schematic illustration showing the entire of the above lift drive controlling device.
Figure 37:
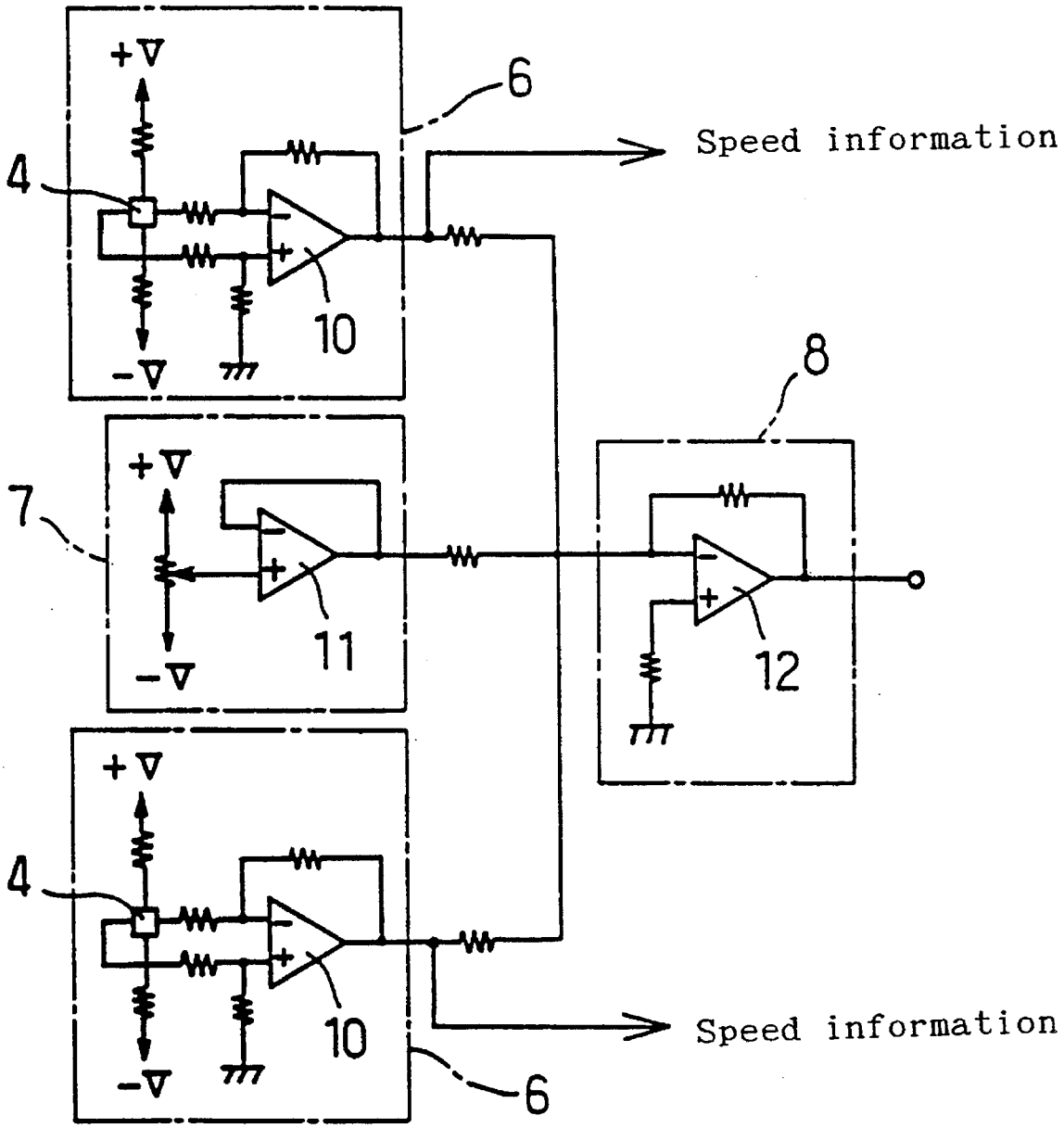
FIG. 37 is a circuit diagram showing the detection circuit to obtain velocity information using a ripple component.

The lift drive control device to be described below comprises using the displacement detector shown in the ninth embodiment to thirteenth embodiment, and the lift device of this embodiment, as shown in FIG. 35, comprises a coil 19, the displacement detecting means 1 for detecting a displacement degree of the wire rope 2 from the pulley's groove, and a speed control means 25 for controlling a driving speed of the wire rope 2 according to the output signal from the displacement detecting means 1. This speed control means 25 is basically the same with conventional ones. In this embodiment, since the speed of the motor 24 is controlled according to a displacement degree detected when the wire rope 2 stretched through the pulley is displaced from the standard position within the pulley's groove, the off-position of the wire rope 2 from the pulley's groove can be prevented automatically and efficiently. Furthermore, as shown in FIG. 36, the safety and carrying capacity of the lift can be synthetically improved by taking the output signal due to the detection of a displacement degree from a plurality of pulleys as a logical sum into the above motor speed control circuit 21. And, the speed of the wire used for the lift drive control device is also detected by the detection circuit shown in FIG. 37. This detection circuit uses a compensation circuit for the ripple component shown in FIG. 16, and by taking out either of the hall element outputs in this compensation circuit, or by detecting the ripple component, information on a speed is obtained. Further, when the detecting coil 19 is mounted on the pulley 13 shown in FIG. 20 and FIG. 21, the output of each detection coil generates a signal in the shape of burst every time the detection coil approaches to the wire by the revolution of the pulley, so that it is possible to use the signal in the shape of burst as a speed signal.

With the aforementioned drive control device for the transfer member such as a lift according to this invention, a displacement degree of the wire rope from the standard point determined in each pulley's groove by the displacement detecting means disposed at several points, and a travelling speed of the lift is synthetically controlled according to each displacement degree, so that the off-position of the wire rope from the pulley's groove can be prevented automatically and efficiently, and the safety and carrying capacity of the lift can be improved sharply.

Figure 38:
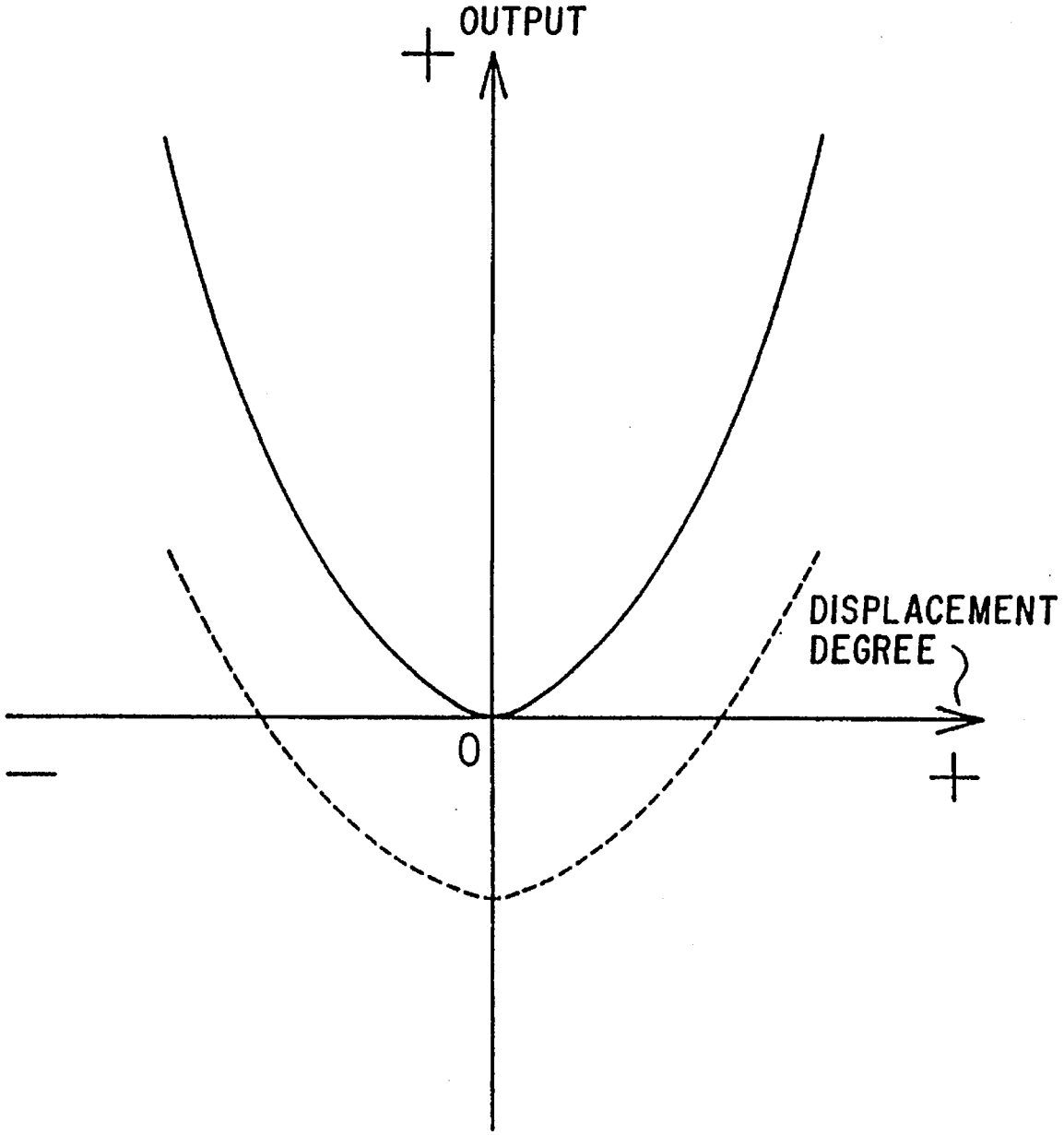
FIG. 38 is a view showing an output characteristics with respect to the displacement degree of the hall element.

And, with the drive control device for the transfer member such as a lift according to this invention, the detection of an abnormality in case of the off-position of the aforementioned rope such as a wire from the guide member such as a pulley can be prevented from taking place, and in an ordinary daily inspection, a displacement of the wire from the pulley or wear of a rubber disposed on the pulley can be checked without going to see it, besides such a check can be made in higher reliability than before. More specifically, at present the daily inspection on the wear of the rubber and the displacement of the wire from the pulley is visually made by an inspector who is in an inspection gondola, but according to this invention, in case of the wear of the rubber of the pulley, a distance between the sensor and the wire becomes short, and as shown in FIG. 38, with respect to the signal output in the ordinary position indicated by the solid line, output of a reversed polarity is obtained as indicated by the dotted line, and thus an abnormality such as the wear of the rubber can be identified instantly and securely.

INDUSTRIAL APPLICABILITY

The aforementioned invention is particularly suitable for ski lifts. Further, in addition to the ski lifts, it can be used for luggage carrying lifts, gondolas, ropeways, etc. as long as a metallic or non-metallic rope is guided by a guide member. And, it can also be used to detect, for example, a breakage, deformation or damage of a rope other than the detection of a displacement degree of a rope with respect to a guide member.

We claim:

1. A displacement detector for detecting a relative position between a wire rope and a pulley of a transfer apparatus, comprising:

a magnet disposed to face the wire rope forming a magnetic circuit together with the wire rope, two magnetoelectric conversion means disposed with a predetermined interval relative to a pitch of lays of the wire rope in an axial direction of the wire rope to produce two output voltages having ripple components caused by said pitch of lays and being opposite to each other in terms of phase, and circuit means connected to the magnetoelectric conversion means for detecting displacement degrees of the wire rope from the pulley according to the output voltages and adding the output voltages so that said ripple components of opposite phases offset each other thereby removing effects of said pitch of lays.

2. A displacement detector according to claim 1, wherein the magnet is a permanent magnet or electromagnet.

3. A displacement detector according to claim 1, wherein the magnetoelectric conversion means is a hall element, magnetic resistor, magnetic diode, or coil.

4. A displacement detector according to claim 1, wherein the predetermined interval is one half of the pitch of lays in the axial direction of the wire rope.

5. A transfer apparatus comprising:

a displacement detector according to claim 1 and supporting means for supporting the displacement detector at a constant distance from the pulley.

6. A transfer apparatus comprising:

a wire rope, a pulley relatively movable with respect to the wire rope, a displacement detector according to claim 1 for detecting a relative position between the wire rope and the pulley, and control means for controlling a driving speed of the wire rope or the pulley according to a relative position output from the displacement detector.

7. A displacement detector for detecting a relative position between a wire rope and a pulley of a transfer apparatus, comprising:

magnet means disposed to face the wire rope for forming a magnetic circuit together with the wire rope, two coils disposed in the magnetic circuit with a predetermined interval relative to a pitch of lays in an axial direction of the wire rope to provide two electromotive forces having ripple components of opposite phases induced by said pitch of lays, and circuit means for detecting displacement degrees of the wire rope from the pulley according to the induced electromotive forces and adding the output voltages so that the ripple components of the opposite phases are offset to remove effects of said pitch of lays.

8. A displacement detector according to claim 7, which further comprises a core of a ferromagnetic substance inserted in each of the coils.

9. A apparatus according to claim 7, wherein the predetermined interval is one half of the pitch of lays in the axial direction of the wire rope.

10. A displacement detector for detecting a relative position between a wire rope and a pulley of a transfer apparatus, comprising:

magnet means disposed to face the wire rope for forming a magnetic circuit together with the wire rope, a coil disposed in the magnetic circuit, a fixed resistor connected in series to said coil, a constant-frequency signal source connected across said series connection of the coil and the fixed resistor to generate AC voltages across the coil, and circuit means for detecting displacement degrees of the wire rope from the pulley according to the AC voltages.

11. A displacement detector for detecting a relative position between a wire rope and a pulley of a transfer apparatus, comprising:

a coil disposed in proximity of pulley's groove, a capacitor connected in parallel to said coil to form a resonance circuit, an oscillator connected in parallel to the resonance circuit to apply a high-frequency signal to the resonance circuit to provide an oscillation output signal having a certain oscillation characteristic, and circuit means for rectifying the oscillation output signal into a DC voltage signal which indicates a degree of displacement of said rope from said pulley.

12. A displacement detector for detecting a relative position between a wire rope and a pulley of a transfer apparatus, comprising:

a plurality of detecting coils disposed on a side face of the pulley at an equal interval in a peripheral direction and connected in series to each other, a movable coil disposed on the pulley and connected to an end of a series connection of the detecting coils, a stationary coil opposed to the movable coil forming a transformer to which an AC voltage is applied, and circuit means connected to both ends of the stationary coil for detecting impedance changes of the detecting coils.

13. A displacement detector according to claim 12, which further comprises a plurality of magnets each opposed to each of the detecting coils.

14. A displacement detector for detecting a relative position between a wire rope and a pulley of a transfer apparatus, the displacement detector comprising:

magnetic means disposed in the vicinity of said wire rope for forming a magnetic field such that a magnetic flux runs from an N pole thereof to an S pole thereof through the wire rope, first and second magnetoelectric conversion means disposed in said magnetic field between the N pole and the wire rope, and the S pole and the wire rope, respectively, so as to produce first and second output voltages, and circuit means for providing a difference between the first output voltage and the second output voltage to determine a displacement degree between the wire rope and the pulley in a horizontal direction and a sum of the first and second output voltages to determine a displacement degree between the wire rope and the pulley in a vertical direction.

15. A displacement detector according to claim 14, wherein said magnetoelectric conversion means are coils.

16. A displacement detector according to claim 14, wherein said magnetoelectric conversion means are Hall elements.

* * * * *